US010632762B2

(12) United States Patent
Obata et al.

(10) Patent No.: US 10,632,762 B2
(45) Date of Patent: Apr. 28, 2020

(54) HEATING APPARATUS AND IMAGE FORMING SYSTEM

(71) Applicant: Ricoh Company, Ltd., Tokyo (JP)

(72) Inventors: Yuuzoh Obata, Tokyo (JP); Kazuyoshi Matsumoto, Tokyo (JP); Ryoh Idehara, Kanagawa (JP); Tsuguyori Kemma, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 68 days.

(21) Appl. No.: 15/866,950

(22) Filed: Jan. 10, 2018

(65) Prior Publication Data

US 2018/0217536 A1 Aug. 2, 2018

(30) Foreign Application Priority Data

Feb. 2, 2017 (JP) ..... 2017-017205
Feb. 6, 2017 (JP) ..... 2017-019850
Oct. 31, 2017 (JP) ..... 2017-210010

(51) Int. Cl.

| | |
|---|---|
| ***B41J 3/407*** | (2006.01) |
| ***B41M 5/00*** | (2006.01) |
| ***B41J 11/00*** | (2006.01) |
| ***G03G 15/16*** | (2006.01) |
| ***G03G 15/00*** | (2006.01) |
| *D06P 5/30* | (2006.01) |
| *D06P 1/44* | (2006.01) |

(52) U.S. Cl.

CPC ..... *B41J 3/4078* (2013.01); *B41J 11/002* (2013.01); *B41M 5/0047* (2013.01); *G03G 15/1695* (2013.01); *G03G 15/6502* (2013.01); *G03G 15/6591* (2013.01); *D06P 1/44* (2013.01); *D06P 5/30* (2013.01); *G03G 2215/00527* (2013.01); *G03G 2215/2019* (2013.01)

(58) Field of Classification Search

CPC .... B41J 3/4078; B41J 11/002; B41M 5/0047; D06P 1/44; D06P 5/30; G03G 2215/2019; G03G 15/6591; G03G 15/6502; G03G 15/1695; G03G 2215/00527

See application file for complete search history.

(56) References Cited

U.S. PATENT DOCUMENTS

| | | | | |
|---|---|---|---|---|
| 2017/0320316 | A1 | 11/2017 | Nakamura et al. | |
| 2017/0320339 | A1 | 11/2017 | Matsumoto et al. | |
| 2018/0105979 | A1* | 4/2018 | Matsumoto | D06P 5/2066 |
| 2018/0147858 | A1* | 5/2018 | Kunioka | B41J 3/4078 |

FOREIGN PATENT DOCUMENTS

| | | |
|---|---|---|
| JP | 2004-330503 | 11/2004 |
| JP | 2013-230651 | 11/2013 |
| JP | 2015-183331 | 10/2015 |
| JP | 2015-218418 | 12/2015 |

* cited by examiner

*Primary Examiner* — Justin Seo
(74) *Attorney, Agent, or Firm* — Xsensus LLP

(57) ABSTRACT

A heating apparatus includes a body and a holder removably placed inside the body. The holder removably holds a heating object. A receiver removably holds the holder. A heater heats the heating object held by the holder held by the receiver. A mover moves one of the receiver and the heater vertically relative to another one of the receiver and the heater to a non-contact heating position where the heating object is isolated from the heater.

20 Claims, 23 Drawing Sheets

HEATING APPARATUS AND IMAGE FORMING SYSTEM

CROSS-REFERENCE TO RELATED APPLICATIONS

This patent application is based on and claims priority pursuant to 35 U.S.C. § 119 to Japanese Patent Application Nos. 2017-017205, filed on Feb. 2, 2017, 2017-019850, filed on Feb. 6, 2017, and 2017-210010, filed on Oct. 31, 2017, in the Japanese Patent Office, the entire disclosure of each of which is hereby incorporated by reference herein.

BACKGROUND

Technical Field

Exemplary aspects of the present disclosure relate to a heating apparatus and an image forming system, and more particularly, to a heating apparatus for heating fabric and an image forming system for printing and heating an image on fabric.

Description of the Background

Related-art fabric printing apparatuses, such as a fabric printer and a textile printer, print on fabric. For example, the fabric printing apparatus includes a preprocessing agent applicator, a presser, a print liquid discharger, and a heater. The preprocessing agent applicator applies a preprocessing agent to a print medium. The presser compresses the print medium applied with the preprocessing agent under heat. The print liquid discharger discharges print liquid to the print medium that is compressed. The heater heats the print medium onto which the print liquid is discharged.

However, the fabric printing apparatus incorporating the preprocessing agent applicator, the presser, the print liquid discharger, and the heater may have a mechanism for cooling and insulation as a target temperature and a heating time increase, upsizing the fabric printing apparatus.

SUMMARY

This specification describes below an improved heating apparatus. In one embodiment, the heating apparatus includes a body and a holder removably placed inside the body. The holder removably holds a heating object. A receiver removably holds the holder. A heater heats the heating object held by the holder held by the receiver. A mover moves one of the receiver and the heater vertically relative to another one of the receiver and the heater to a non-contact heating position where the heating object is isolated from the heater.

This specification further describes an improved image forming system. In one embodiment, the image forming system includes a cloth holder, a printer, and a heating apparatus. The cloth holder removably holds fabric. The printer is removably attached with the cloth holder and prints an image on the fabric held by the cloth holder. The heating apparatus is removably attached with the cloth holder and heats the fabric bearing the image and being held by the cloth holder. The heating apparatus includes a body inside which the cloth holder is removably placed. A receiver removably holds the cloth holder. A heater heats the fabric held by the cloth holder held by the receiver. A mover moves one of the receiver and the heater vertically relative to another one of the receiver and the heater to a non-contact heating position where the fabric is isolated from the heater.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
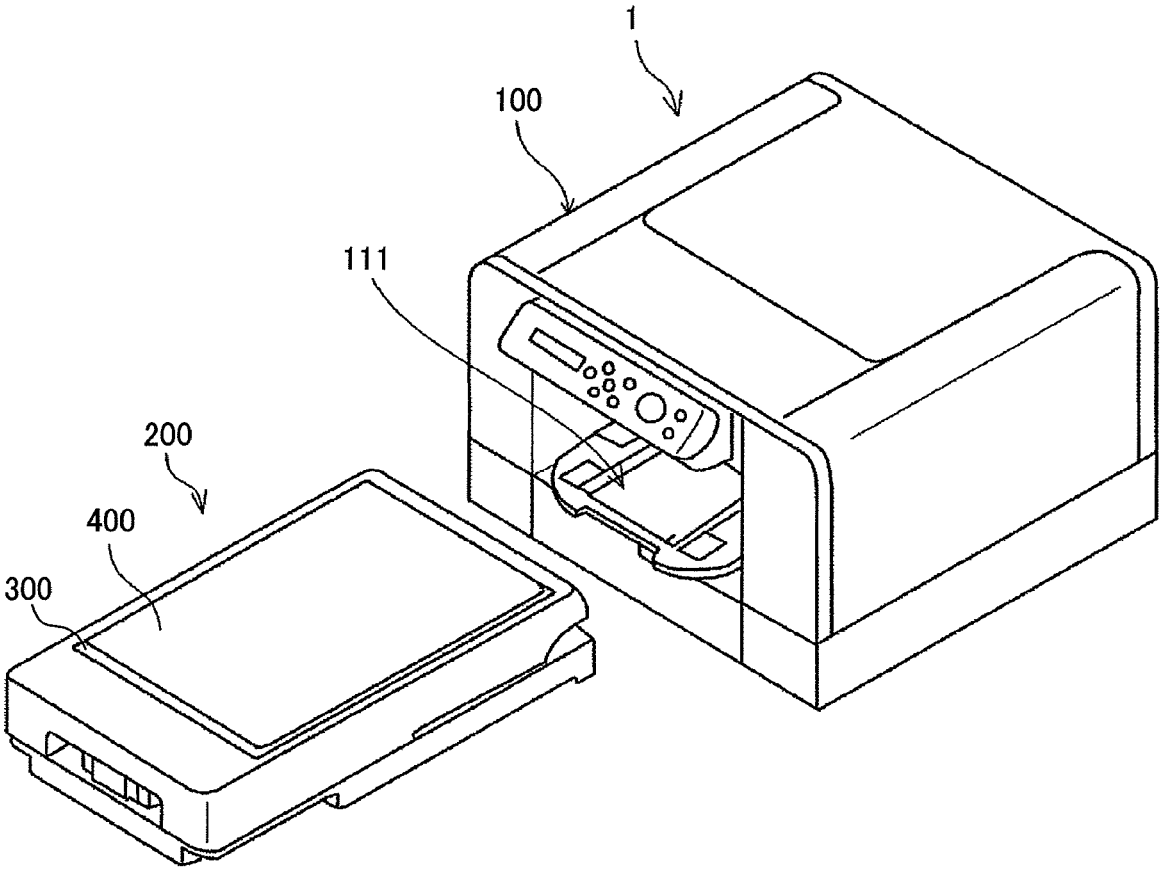
FIG. 1 is an external perspective view of a printer according to an embodiment of the present disclosure, illustrating a cassette removed from the printer.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

Referring to FIGS. 1 to 4, a description is provided of one example of a construction of a printer 1.

Figure 2:
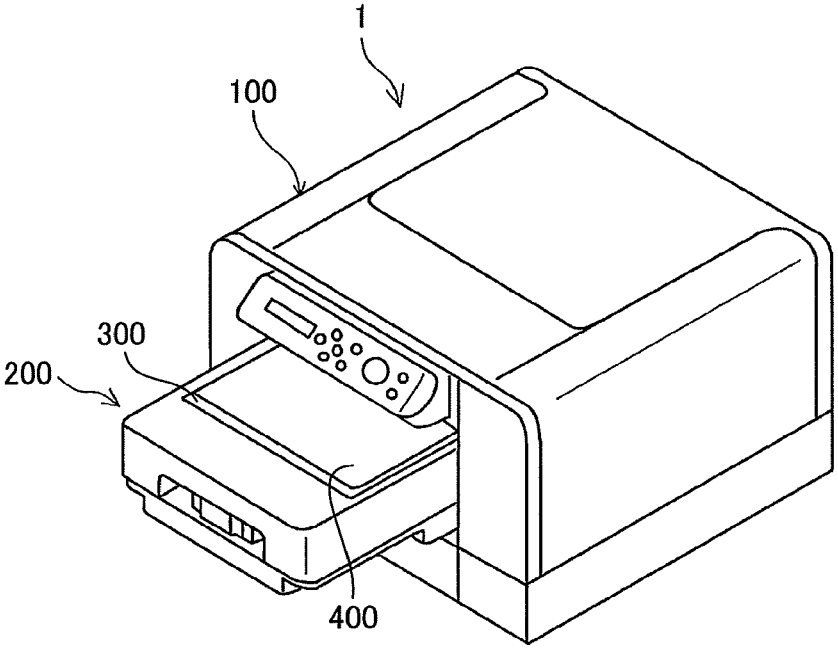
FIG. 2 is an external perspective view of the printer depicted in FIG. 1 attached with the cassette.
Figure 3:
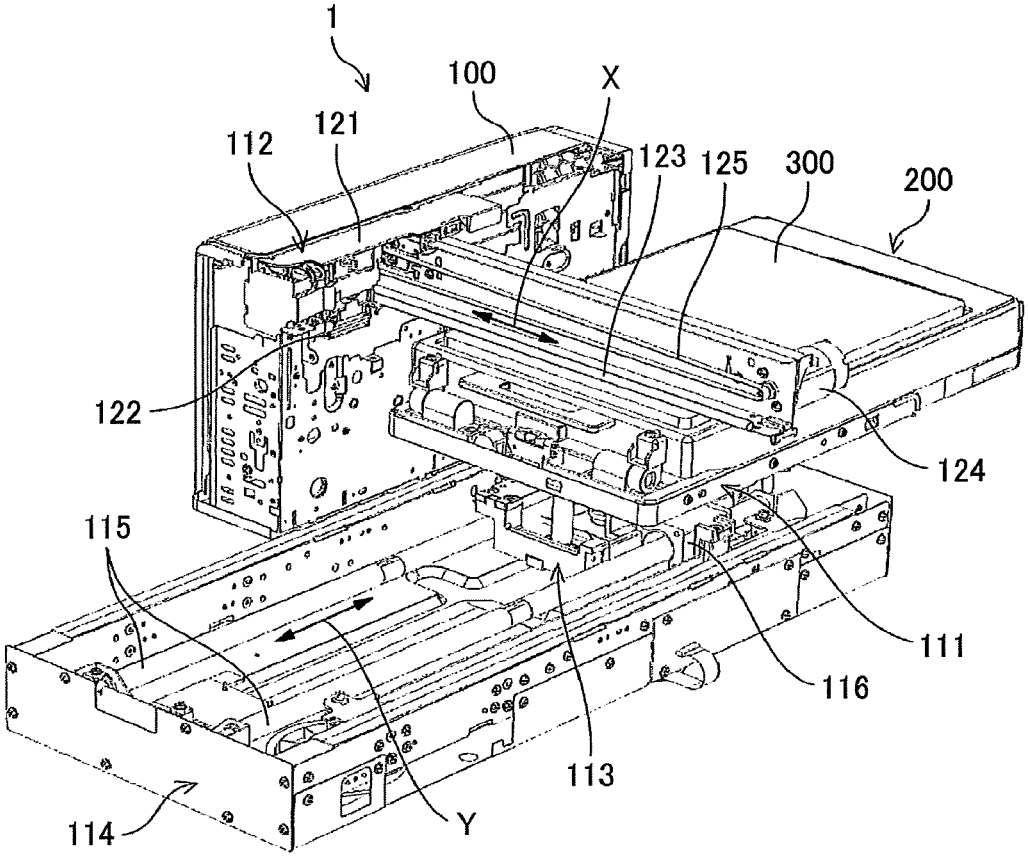
FIG. 3 is an internal perspective view of the printer depicted in FIG. 2, illustrating an entire mechanical section thereof seen from a first direction.
Figure 4:
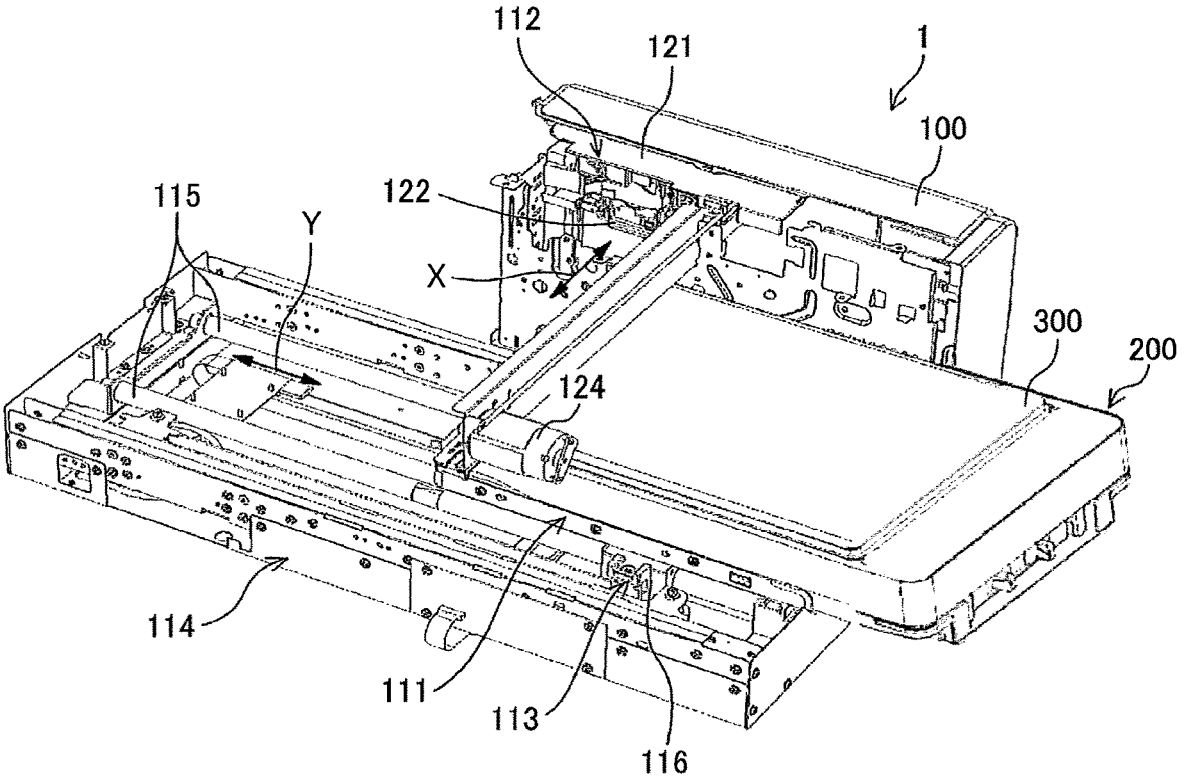
FIG. 4 is an internal perspective view of the printer depicted in FIG. 3, illustrating the entire mechanical section thereof seen from a second direction different from the first direction in FIG. 3.

FIG. 1 is an external perspective view of the printer 1 and a cassette 200 removed from the printer 1. FIG. 2 is an external perspective view of the printer 1 attached with the cassette 200. FIG. 3 is an internal perspective view of the printer 1, illustrating an entire mechanical section thereof seen from a first direction. FIG. 4 is an internal perspective view of the printer 1, illustrating the entire mechanical section thereof seen from a second direction different from the first direction in FIG. 3.

As illustrated in FIGS. 1 to 4, the printer 1 serving as a fabric printing apparatus includes a body 100. Inside the body 100 are the cassette 200, a stage 111, and a printing device 112. The cassette 200 serves as a holder that removably holds a cloth 400 (e.g., a fabric). The stage 111 serves as a receiver that removably holds the cassette 200 and is movable back and forth. As illustrated in FIG. 3, the printing device 112 prints an image on the cloth 400 placed on the cassette 200 held by the stage 111.

For example, the cloth 400 includes a piece of cloth such as a handkerchief and towel, a fabric manufactured as clothes such as a T-shirt and a sweatshirt, and a fabric used as a part of a product such as a tote bag.

As illustrated in FIG. 3, the stage 111 is disposed above a conveyer 113 movably supported by the body 100 such that the conveyer 113 is movable in a direction Y in a feed direction. The body 100 includes a bottom frame 114 that mounts a conveyance guide 115 along the direction Y. The conveyance guide 115 movably supports a slider 116 of the conveyer 113.

The printing device 112 includes a carriage 121 and a head 122. The carriage 121 moves relative to the stage 111 in a direction X, that is, a main scanning direction. The head 122 is mounted on the carriage 121. The carriage 121 is movably supported by a guide 123 extending in the direction X. A driving motor 124 reciprocally moves the carriage 121 in the direction X via a main scanning mechanical section such as a timing belt 125. The head 122 is a liquid discharge head that discharges ink onto a surface of the cloth 400 to form an image on the cloth 400. Alternatively, other types of heads may be employed as the head 122.

The cassette 200 includes a platen 300 on which the cloth 400 is placed. The cassette 200 mounting the cloth 400 is attached to the stage 111 that holds the cassette 200 inside the body 100. As the stage 111 moves in the direction Y and the head 122 reciprocally moves in the direction X repeatedly, the head 122 prints a desired image on the cloth 400.

Figure 5:
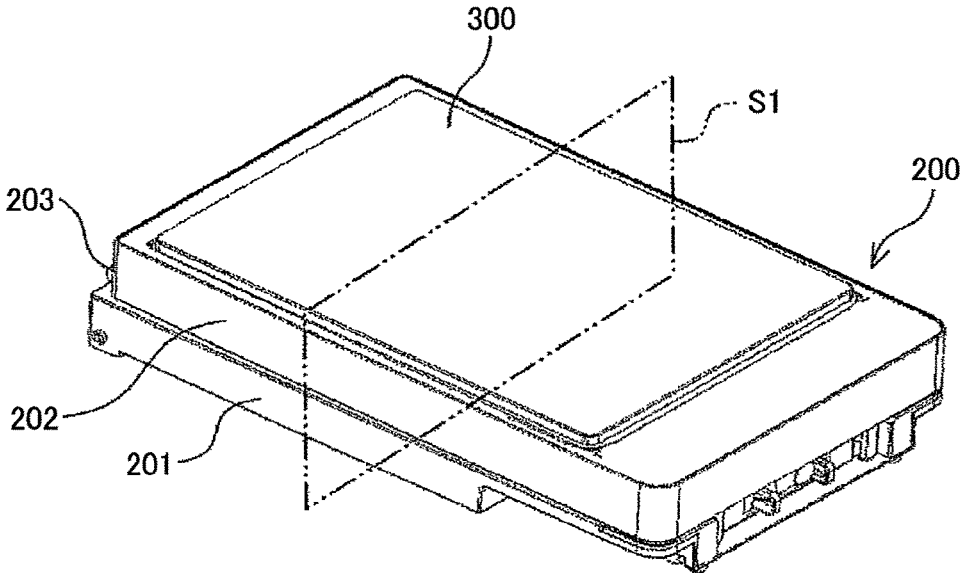
FIG. 5 is a perspective view of the cassette depicted in FIG. 1.
Figure 6:
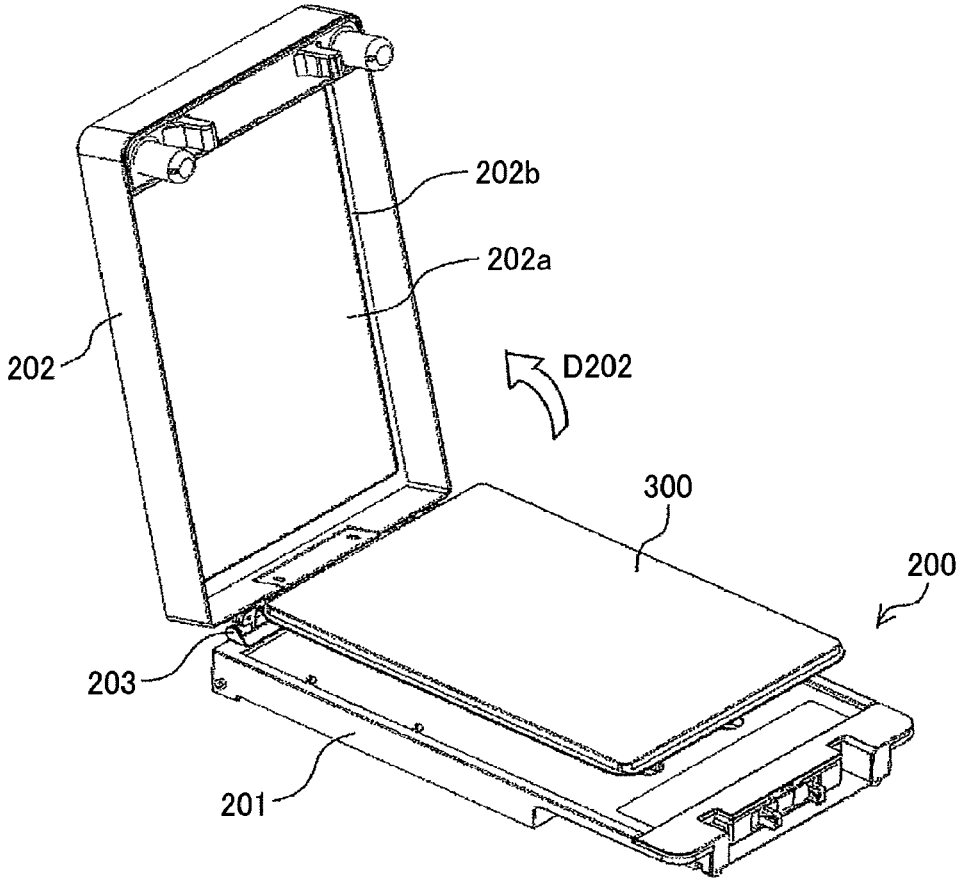
FIG. 6 is a perspective view of the cassette depicted in FIG. 5, illustrating a platen flange cover that is lifted.
Figure 7:
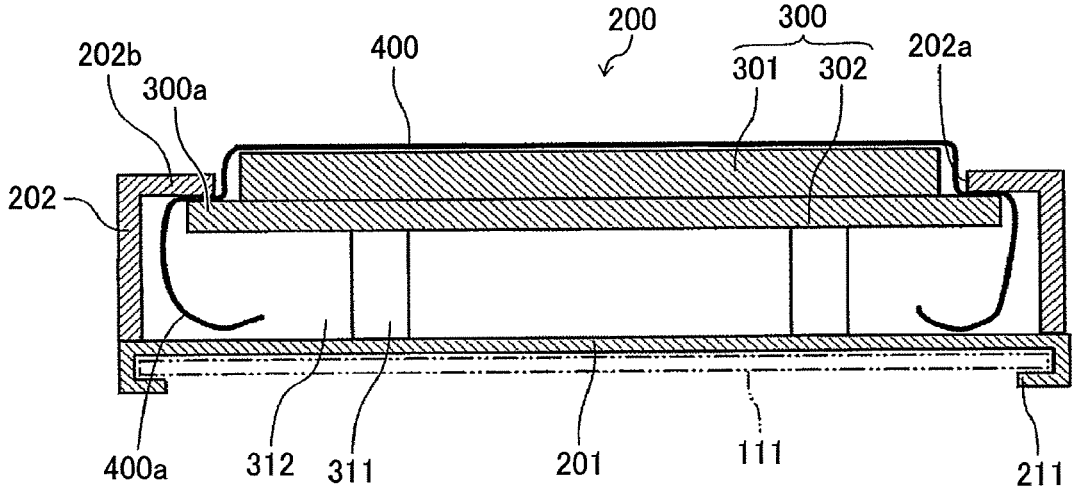
FIG. 7 is a schematic cross-sectional view of the cassette depicted in FIG. 5 in a short direction thereof taken on a cross-section in FIG. 6.

Referring to FIGS. 5 to 7, a description is provided of a construction of the cassette 200 serving as a cloth holder or a holder.

FIG. 5 is a perspective view of the cassette 200. FIG. 6 is a perspective view of the cassette 200, illustrating a platen flange cover 202 that is lifted. FIG. 7 is a schematic cross-sectional view of the cassette 200 in a short direction thereof taken on a cross-section S1 in FIG. 5.

As illustrated in FIG. 5, the cassette 200 (e.g., a tray) includes a cassette base 201 that serves as a base or a tray base and the platen 300 that holds the cloth 400 and keeps a print portion of the cloth 400 where the image is printed to be planar.

As illustrated in FIG. 7, the platen 300 includes a platen base 302 and an insulator 301 that includes a mount face that mounts the cloth 400 and keeps the cloth 400 to be planar. The insulator 301 is resistant against heat generated by a heating apparatus 500 described below.

As illustrated in FIGS. 5 and 6, the cassette 200 includes the platen flange cover 202 and a hinge 203. One end of the platen flange cover 202 serving as a flange cover in a longitudinal direction of the cassette 200 is pivotally attached to and supported by the cassette base 201 through the hinge 203. Thus, as illustrated in FIG. 6, the platen flange cover 202 is lifted relative to the cassette base 201 in a direction D202.

As illustrated in FIG. 6, the platen flange cover 202 includes a frame 202*b* defining a slot 202*a*, that is, an opening, disposed opposite the platen 300. As illustrated in FIG. 7, the platen 300 includes a flange 300*a* disposed at a rim of the platen 300. The frame 202*b* of the platen flange cover 202 presses the cloth 400 against the flange 300*a* of the platen 300.

The cassette 200 is attached to the stage 111 disposed inside the body 100 in an attachment-detachment direction. The cassette base 201 mounts guide rails 211 at both lateral ends of the cassette 200 in a direction perpendicular to the attachment-detachment direction. The guide rails 211 movably engage both lateral ends of the stage 111 in the direction perpendicular to the attachment-detachment direction such that the guide rails 211 hold both lateral ends of the stage 111, respectively.

A plurality of supports 311 mounted on the cassette base 201 supports the platen 300. The platen 300 and the cassette base 201 define an accommodation chamber 312 (e.g., an accommodation space) that accommodates a surplus portion 400*a* of the cloth 400. For example, the surplus portion 400*a* may be sleeves, a neck, a hem, and the like of a T-shirt, if an image is printed on a front of the T-shirt.

The platen 300 is removably attached to the cassette base 201 and is replaceable. Accordingly, a plurality of platens 300 may be used for printing. While a first platen 300 is used for a print job, a user wraps a cloth 400 (e.g., a garment) around a second platen 300 to be used for a next print job. After the print job and a fixing job are finished, the first platen 300 is replaced with the second platen 300 to start the next print job quickly.

In order to set the cloth 400 on the cassette 200, the user lifts and opens the platen flange cover 202 as illustrated in FIG. 6 and places the cloth 400 on the platen 300. In a state in which the accommodation chamber 312 accommodates the surplus portion 400*a* of the cloth 400 as illustrated in FIG. 7, the user lowers and closes the platen flange cover 202 as illustrated in FIG. 5.

In order to print on the cloth 400, the user attaches or sets the cassette 200 mounting the cloth 400 onto the stage 111 disposed inside the body 100 of the printer 1 as illustrated in FIG. 4. The user attaches the cassette 200 to the stage 111 in the direction Yin which the stage 111 moves. Accordingly, compared to a configuration in which the user attaches the cassette 200 onto the stage 111 vertically, the stage 111 is not exposed from the body 100 entirely, resulting in downsizing of the printer 1.

As described above, the user removes the cassette 200 entirely from the body 100 and sets the cloth 400, onto which the image is to be printed, on the platen 300 readily.

After the printer 1 finishes printing on the cloth 400, the user moves the cassette 200 mounting the cloth 400 from the printer 1 to the heating apparatus 500 and sets the cassette 200 inside the heating apparatus 500. The heating apparatus 500 fixes the image on the cloth 400 under heat.

Figure 8:
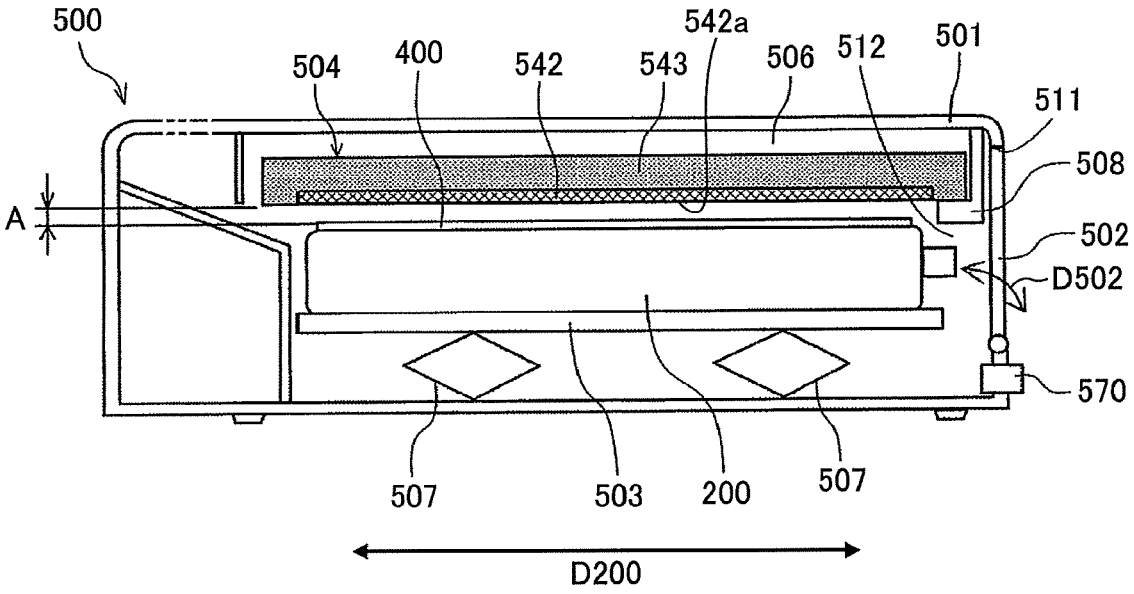
FIG. 8 is a cross-sectional view of a heating apparatus according to a first embodiment of the present disclosure in an attachment-detachment direction of the cassette depicted in FIG. 5 while a front door is closed.
Figure 9:
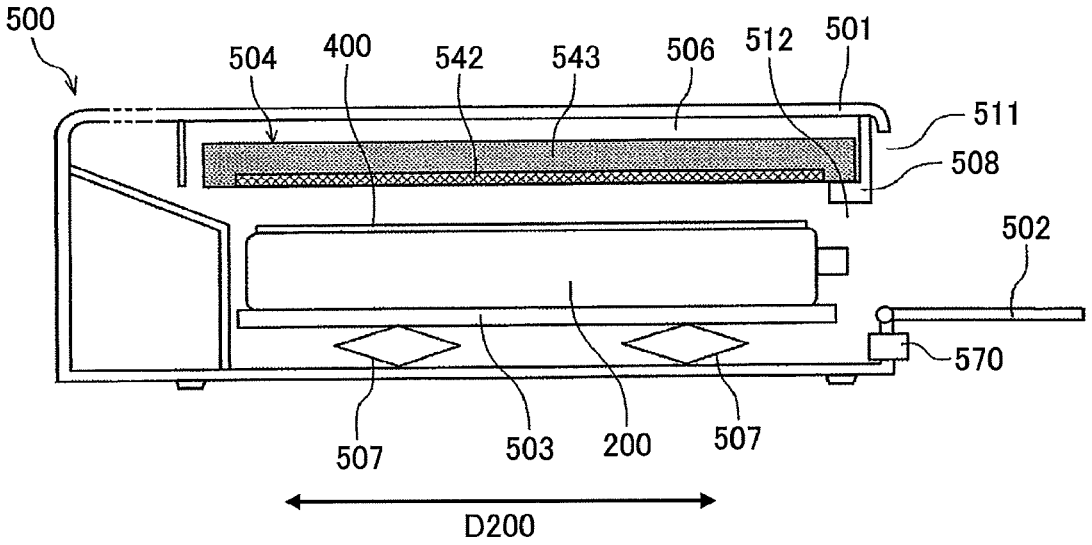
FIG. 9 is a cross-sectional view of the heating apparatus depicted in FIG. 8 in the attachment-detachment direction of the cassette while the front door is opened.
Figure 10:
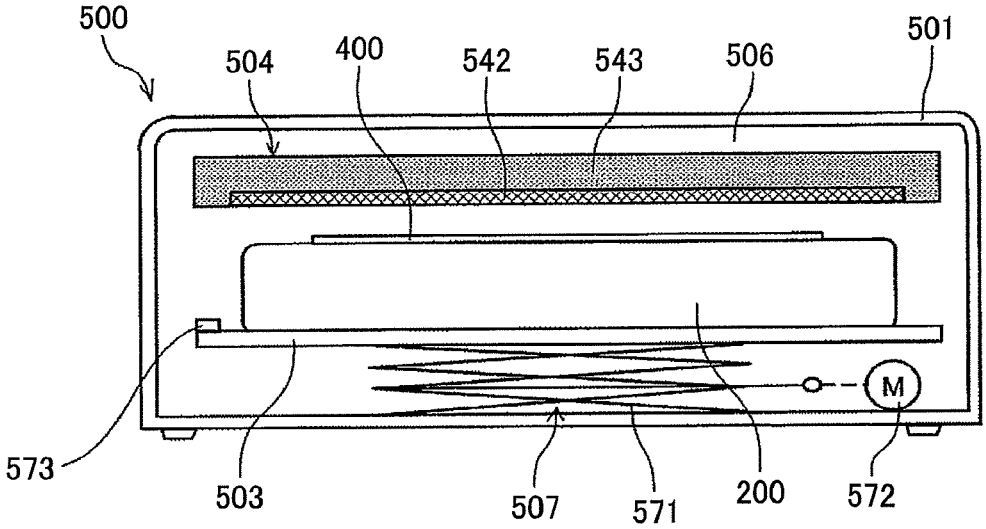
FIG. 10 is a cross-sectional view of the heating apparatus depicted in FIG. 8 in a direction perpendicular to the attachment-detachment direction of the cassette.

Referring to FIGS. 8 to 10, a description is provided of a construction of the heating apparatus 500 according to a first embodiment.

FIG. 8 is a cross-sectional view of the heating apparatus 500 in an attachment-detachment direction D200 of the cassette 200 while a front door 502 is closed. FIG. 9 is a cross-sectional view of the heating apparatus 500 in the attachment-detachment direction D200 of the cassette 200 while the front door 502 is opened. FIG. 10 is a cross-sectional view of the heating apparatus 500 in a direction perpendicular to the attachment-detachment direction D200 of the cassette 200.

The heating apparatus 500 heats a fabric (e.g., the cloth 400). As illustrated in FIG. 8, the heating apparatus 500 includes a body 501, an opening 511, and the front door 502. The front door 502 is disposed at a front of the body 501 and is opened and closed to expose and cover the opening 511. The cassette 200 serving as a cloth holder or a holder that holds the cloth 400 is inserted into and removed from the body 501 through the opening 511.

As illustrated in FIG. 8, the front door 502 is opened and closed in a direction D502. As illustrated in FIG. 9, the front door 502 is opened flat. While the front door 502 is opened, the cassette 200 serving as a cloth holder or a holder that holds the cloth 400 serving as a heating object is inserted into and removed from the body 501 through the opening 511.

Inside the body 501 are a receiver 503 and a heater 504. The receiver 503 removably holds the cassette 200 that removably holds the cloth 400. The heater 504 heats the cloth 400 held by the cassette 200.

Like the stage 111 of the printer 1 depicted in FIG. 1, the receiver 503 is a holder to which the cassette 200 is removably attached, a table on which the cassette 200 is placed, or the like.

As described above, the cassette 200 mounting the cloth 400 is also removably attached to the printer 1 that prints an image on the cloth 400.

The heater 504 includes a heating portion 542 and an insulator 543. The heating portion 542 is disposed opposite the cloth 400 held by the cassette 200. The insulator 543 insulates components disposed opposite the receiver 503 via the heating portion 542 from heat generated by the heating portion 542. A clearance 506 (e.g., a space) is disposed between the insulator 543 and an interior wall of the body 501.

As illustrated in FIG. 8, the heating portion 542 includes an opposed face 542*a* disposed opposite the receiver 503. The opposed face 542*a* is substantially parallel to an exposed face of the cloth 400 held by the cassette 200 placed inside the body 501. The exposed face of the cloth 400 is exposed to the heating portion 542 while the cassette 200 is placed inside the body 501.

A plate may be interposed between the heating portion 542 and the receiver 503. For example, the plate is made of a material having an enhanced thermal conductivity such as aluminum. The plate is heated by the heating portion 542 to a surface temperature that is substantially even. Thus, the plate conducts heat to the cloth 400 at the substantially even surface temperature regardless of the heating position where the heating portion 542 heats the cloth 400.

A holder 508 disposed in proximity to the opening 511 supports the heater 504. According to this embodiment, a lower end of the holder 508 defines an insertion opening 512 through which the cassette 200 is inserted into the body 501. Alternatively, if an upper end of the opening 511 is below the lower end of the holder 508, the opening 511 serves as the insertion opening 512.

A plurality of lifts 507 supporting the receiver 503 serves as a relative mover or a mover which moves, that is, lifts and lowers, the receiver 503 relative to the heater 504 vertically in FIG. 8. The lifts 507 move the receiver 503 such that the cloth 400 serving as a heating object that is heated by the heater 504 is situated at a non-contact heating position where the cloth 400 is isolated from the heater 504.

For example, as illustrated in FIG. 10, the lift 507 is a pantograph lift including a jack 571 that is a pantograph type and a motor 572 that lifts and lowers the jack 571 vertically in FIG. 10.

As the user operates a button 570 depicted in FIG. 8 disposed at the front of the body 501, the lifts 507 expand and contract to lift and lower the receiver 503 in a predetermined amount, adjusting an interval between the receiver 503 and the heating portion 542 of the heater 504.

As illustrated in FIG. 10, the receiver 503 mounts a distance sensor 573 that measures the distance from the receiver 503 to the heating portion 542 of the heater 504 so that the height, that is, the vertical position, of the receiver 503 is finely adjusted based on the thickness of the cloth 400.

With the above-described construction of the heating apparatus 500, as illustrated in FIG. 9, the user opens the front door 502 and sets the cassette 200 mounting the cloth 400 bearing the image onto the receiver 503 disposed inside the body 501 of the heating apparatus 500.

Subsequently, as illustrated in FIG. 8, the user closes the front door 502, causes the lifts 507 to lift the receiver 503, and causes the lifts 507 to halt at a position where an interval A is provided between the cloth 400 set on the cassette 200 and the heating portion 542, for example.

As the heating portion 542 of the heater 504 is supplied with power and generates heat, the heating portion 542 heats the cloth 400 held by the cassette 200 to fix liquid (e.g., ink), with which the image is printed on the cloth 400, on the cloth 400.

As described above, the heating apparatus 500 is separated from the printer 1, resulting in downsizing of the heating apparatus 500.

The heating apparatus 500 includes a holder (e.g., the cassette 200), a receiver (e.g., the receiver 503), a heater (e.g., the heater 504), and a mover (e.g., the lifts 507). The holder removably holds a heating object (e.g., the cloth 400). The receiver removably holds the holder. The heater heats the heating object. The mover moves the receiver vertically relative to the heater to a non-contact heating position where the heater heats the heating object held by the holder held by the receiver without contacting the heating object. According to this embodiment, the mover moves the receiver vertically relative to the heater to the non-contact heating position.

Accordingly, the heater heats the heating object held by the holder, enhancing usability of the user who sets the holder inside the printer 1 that prints an image on the heating object and usability of the user who sets the holder inside the heating apparatus 500 that heats the heating object.

Figure 11:
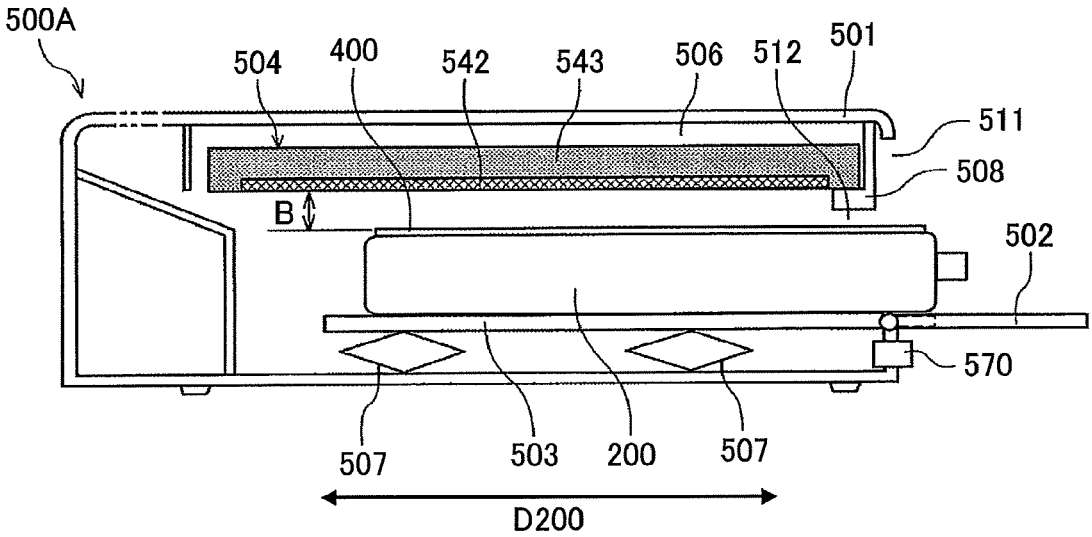
FIG. 11 is a cross-sectional view of a heating apparatus according to a second embodiment of the present disclosure in the attachment-detachment direction of the cassette depicted in FIG. 5.

Referring to FIG. 11, a description is provided of a construction of a heating apparatus 500A according to a second embodiment.

FIG. 11 is a cross-sectional view of the heating apparatus 500A in the attachment-detachment direction D200 of the cassette 200.

According to this embodiment, the receiver 503 lifts and lowers in accordance with opening and closing of the front door 502.

As illustrated in FIG. 11, as the user opens the front door 502 flat and exposes the opening 511, the receiver 503 lowers to a set position where the user sets the cassette 200 on the receiver 503.

When the receiver 503 is at the set position where the user sets the cassette 200 mounting the cloth 400 onto the receiver 503, an interval B is provided between the cloth 400 and the heating portion 542. The interval B is greater than the interval A depicted in FIG. 8 produced when the heating portion 542 heats the cloth 400.

As the front door 502 is closed, the receiver 503 interlocked with the front door 502 lifts in accordance with motion of the front door 502 to the non-contact heating position depicted in FIG. 8 where the heating portion 542 isolated from the cloth 400 heats the cloth 400.

As described above, the receiver 503 lifts and lowers in accordance with closing and opening of the front door 502, simplifying an operation of the user and enhancing usability of the user.

If the receiver 503 is not configured to lift and lower in accordance with closing and opening of the front door 502 serving as a door, when the user opens the front door 502 while the receiver 503 is lifted and attaches the cassette 200 to the receiver 503, a print face of the cloth 400 that bears unfixed liquid may come into contact with peripherals such as a frame and a cover of the body 501, thus staining the peripherals and degrading an image on the cloth 400. To address this circumstance, according to this embodiment in which the receiver 503 is interlocked with the front door 502, when the user inserts the cassette 200 into the body 501, the receiver 503 lowers precisely.

Figure 12:
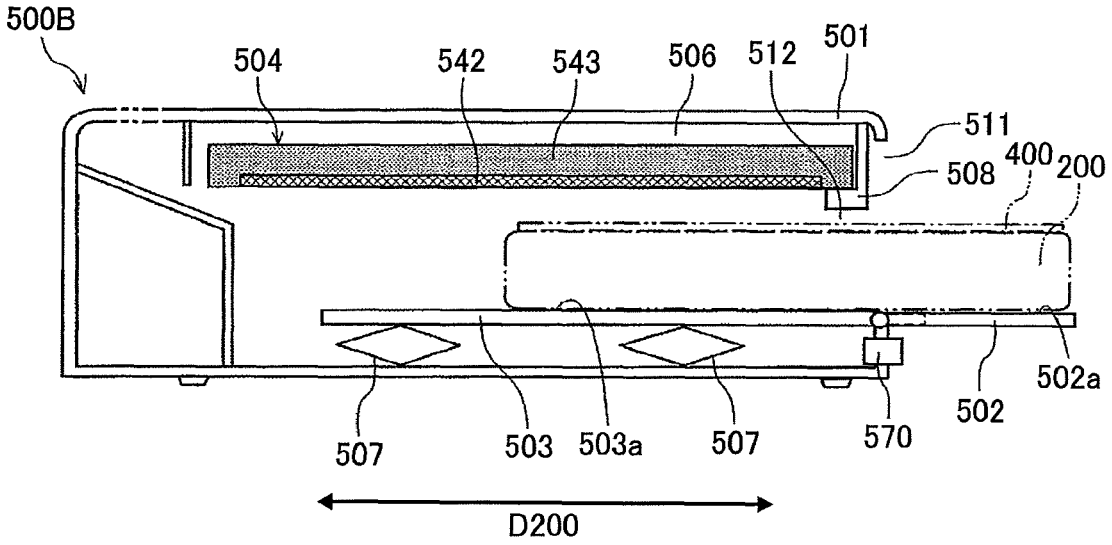
FIG. 12 is a cross-sectional view of a heating apparatus according to a third embodiment of the present disclosure in the attachment-detachment direction of the cassette depicted in FIG. 5.

Referring to FIG. 12, a description is provided of a construction of a heating apparatus 500B according to a third embodiment.

FIG. 12 is a cross-sectional view of the heating apparatus 500B in the attachment-detachment direction D200 of the cassette 200.

The front door 502 includes an interior face 502*a* (e.g., a back face) that serves as an interior face of the body 501. The receiver 503 includes a receiving face 503*a* that receives the cassette 200. According to this embodiment, while the front door 502 is opened and situated at an open position, a height of the interior face 502*a* of the front door 502 is equivalent to a height of the receiving face 503*a* of the receiver 503.

The interior face 502*a* of the front door 502 is contiguous to the receiving face 503*a* of the receiver 503. Accordingly, the cassette 200 is inserted into the body 501 along the interior face 502*a* of the front door 502, facilitating attachment of the cassette 200 to the receiver 503.

The interior face 502*a* of the front door 502 serves as a receiving face that receives the cassette 200 as the cassette 200 is inserted into the body 501, allowing the user to insert the cassette 200 from the front of the body 501 such that the cassette 200 is substantially parallel to the heating portion 542.

Accordingly, when the cassette 200 mounting the cloth 400 bearing an unfixed image is inserted into and set to the body 501, the heating portion 542 and peripheral components do not scratch the cloth 400, preventing degradation of the image on the cloth 400.

Figure 13:
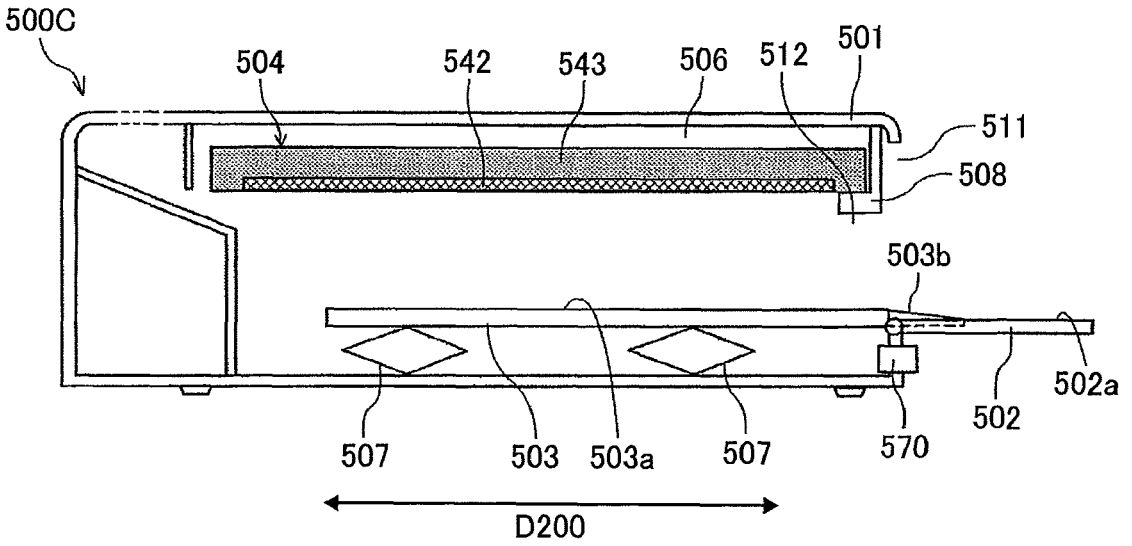
FIG. 13 is a cross-sectional view of a heating apparatus according to a fourth embodiment of the present disclosure in the attachment-detachment direction of the cassette depicted in FIG. 5.

Referring to FIG. 13, a description is provided of a construction of a heating apparatus 500C according to a fourth embodiment.

FIG. 13 is a cross-sectional view of the heating apparatus 500C in the attachment-detachment direction D200 of the cassette 200.

According to this embodiment, the receiver 503 includes a slope 503*b* disposed at one end of the receiver 503 that is in proximity to the front door 502. While the front door 502 is opened, the receiving face 503*a* of the receiver 503 is contiguous to the interior face 502*a* of the front door 502 via the slope 503*b*.

Since the interior face 502*a* of the front door 502 is contiguous to the receiving face 503*a* of the receiver 503 via the slope 503*b*, the cassette 200 is inserted into the body 501 along the interior face 502*a* of the front door 502, facilitating attachment of the cassette 200 to the receiver 503.

Accordingly, when the cassette 200 mounting the cloth 400 bearing an unfixed image is inserted into and set to the body 501, the heating portion 542 and peripheral components do not scratch the cloth 400, preventing degradation of the image on the cloth 400.

Figure 14:
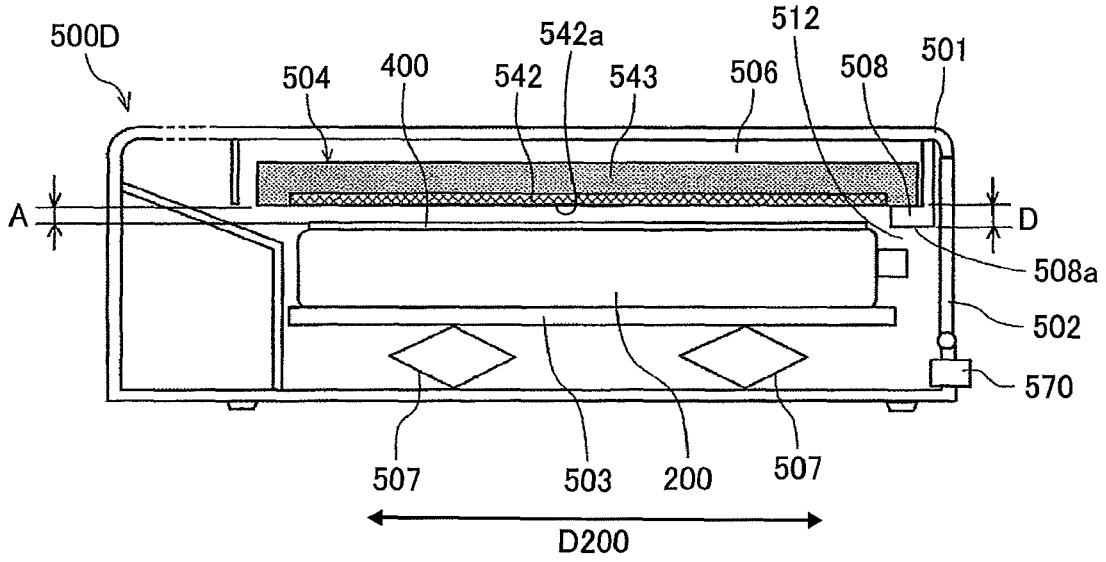
FIG. 14 is a cross-sectional view of a heating apparatus according to a fifth embodiment of the present disclosure in the attachment-detachment direction of the cassette depicted in FIG. 5.

Referring to FIG. 14, a description is provided of a construction of a heating apparatus 500D according to a fifth embodiment.

FIG. 14 is a cross-sectional view of the heating apparatus 500D in the attachment-detachment direction D200 of the cassette 200.

According to this embodiment, at least when the heater 504 heats the cloth 400 held by the cassette 200, the receiver 503 lifts to a position where the surface of the cloth 400 is higher than an upper end of the insertion opening 512.

The holder 508 supporting the heater 504 is interposed between the heater 504 and the opening 511. Hence, a lower face 508*a* of the holder 508 defines the insertion opening 512 below the lower face 508*a*. The cassette 200 is inserted into the body 501 through the insertion opening 512.

The upper end of the insertion opening 512 is disposed below the heating portion 542 by an interval D. The receiver 503 attached with the cassette 200 mounting the cloth 400 is lifted to a position where the interval A between the surface of the cloth 400 and a surface, that is, the opposed face 542*a*, of the heating portion 542 is smaller than the interval D.

Accordingly, while the heater 504 heats the cloth 400, even if the front door 502 is opened, the receiver 503 prohibits the user from inserting his or her hand below the heater 504.

Figure 15A:
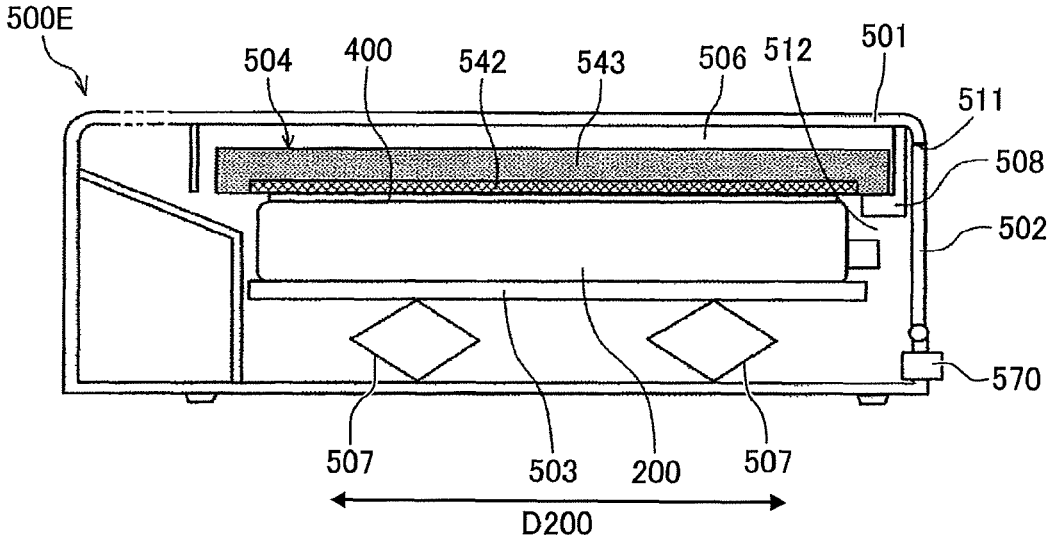
FIG. 15A is a cross-sectional view of a heating apparatus according to a sixth embodiment of the present disclosure in the attachment-detachment direction of the cassette depicted in FIG. 5, illustrating a contact heating position of a cloth.
Figure 15B:
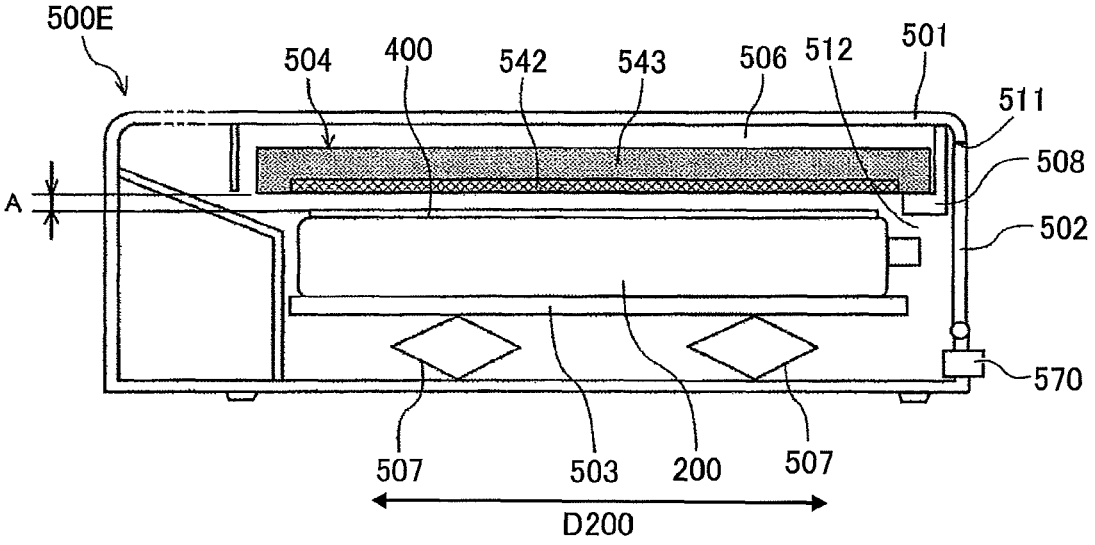
FIG. 15B is a cross-sectional view of the heating apparatus depicted in FIG. 15A in the attachment-detachment direction of the cassette depicted in FIG. 5, illustrating a non-contact heating position of the cloth.

Referring to FIGS. 15A and 15B, a description is provided of a construction of a heating apparatus 500E according to a sixth embodiment.

FIG. 15A is a cross-sectional view of the heating apparatus 500E in the attachment-detachment direction D200 of the cassette 200, illustrating a contact heating position of the cloth 400. FIG. 15B is a cross-sectional view of the heating apparatus 500E in the attachment-detachment direction D200 of the cassette 200, illustrating the non-contact heating position of the cloth 400.

According to this embodiment, the lifts 507 move the receiver 503 to the contact heating position depicted in FIG. 15A and the non-contact heating position depicted in FIG. 15B selectively. At the contact heating position depicted in FIG. 15A, the cloth 400 held by the cassette 200 attached to the receiver 503 contacts the heating portion 542 of the heater 504. At the non-contact heating position depicted in FIG. 15B, the cloth 400 held by the cassette 200 attached to the receiver 503 is isolated from the heating portion 542 of the heater 504 with the interval A therebetween.

The user selects to which of the contact heating position and the non-contact heating position the lifts 507 move the receiver 503 with a lever or the button 570 disposed at the front of the body 501. Alternatively, like the first embodiment, a driver (e.g., the motor 572 depicted in FIG. 10) that drives the lifts 507 may change a driving amount.

With the above-described construction of the heating apparatus 500E, in a pre-printing process before the printer 1 prints an image on the cloth 400, as illustrated in FIG. 15A, the lifts 507 lift the receiver 503 to the contact heating position where the cloth 400 held by the cassette 200 attached to the receiver 503 contacts the heating portion 542 of the heater 504. The heater 504 heats the cloth 400 while the cloth 400 is pressed against the heater 504.

Since the heater 504 heats the cloth 400 pressed against the heater 504, the heater 504 stretches the cloth 400 that is creased, suppresses fluffing of the cloth 400, and flattens the cloth 400 precisely, thus improving print quality.

Accordingly, the heating apparatus 500E performs both a post-printing process in which the heater 504 heats and fixes liquid of the image on the cloth 400 after the image is printed on the cloth 400 and a preheating process in which the heater 504 preheats the cloth 400 to eliminate creases and fluff on the surface of the cloth 400 before a printing process in which the printer 1 prints the image on the cloth 400.

In the post-printing process after the printer 1 prints the image on the cloth 400, as illustrated in FIG. 15B, the lifts 507 lift the receiver 503 to the non-contact heating position where the cloth 400 held by the cassette 200 attached to the receiver 503 is isolated from the heating portion 542 of the heater 504. The heater 504 heats the cloth 400 while the cloth 400 is isolated from the heater 504.

Thus, the heating apparatus 500E fixes liquid of the image on the cloth 400 without degrading quality of the image printed on the cloth 400.

Figure 16:
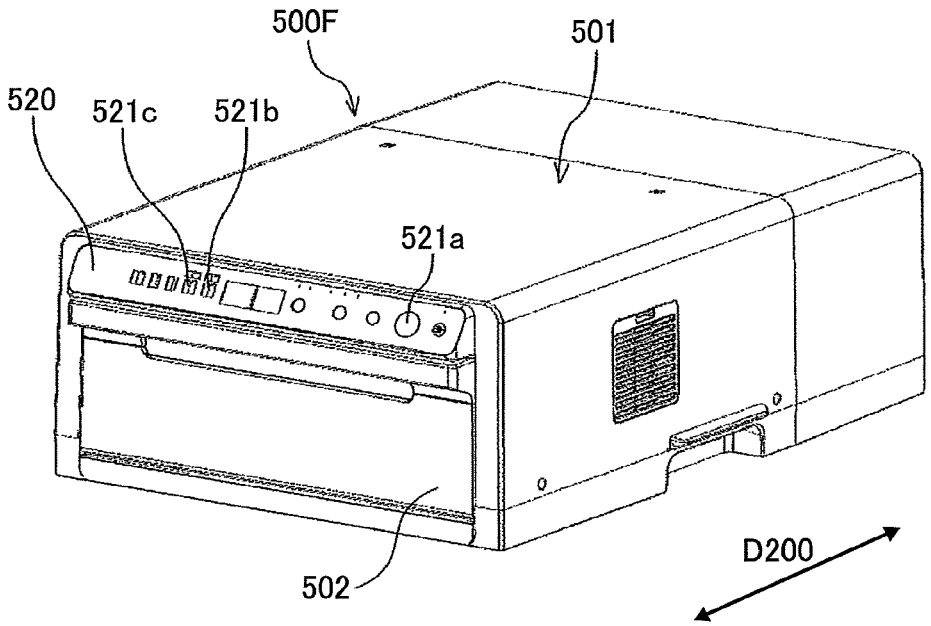
FIG. 16 is an external perspective view of a heating apparatus according to a seventh embodiment of the present disclosure.
Figure 17:
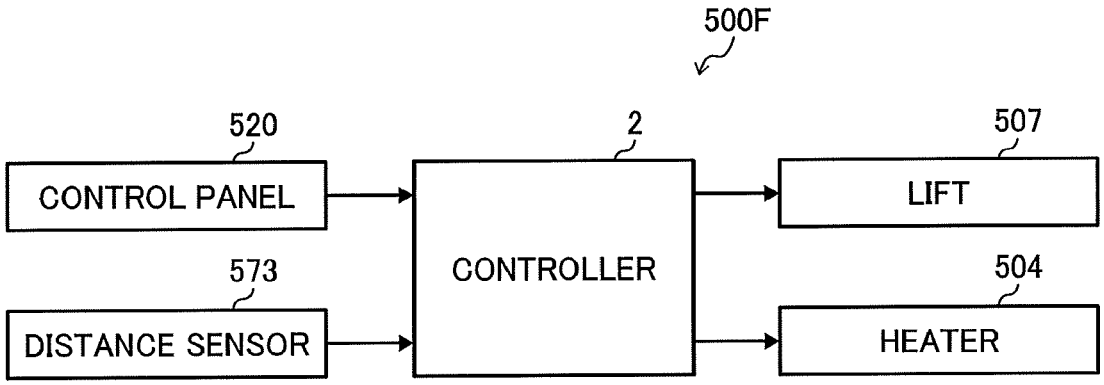
FIG. 17 is a block diagram of the heating apparatus depicted in FIG. 16.
Figure 18:
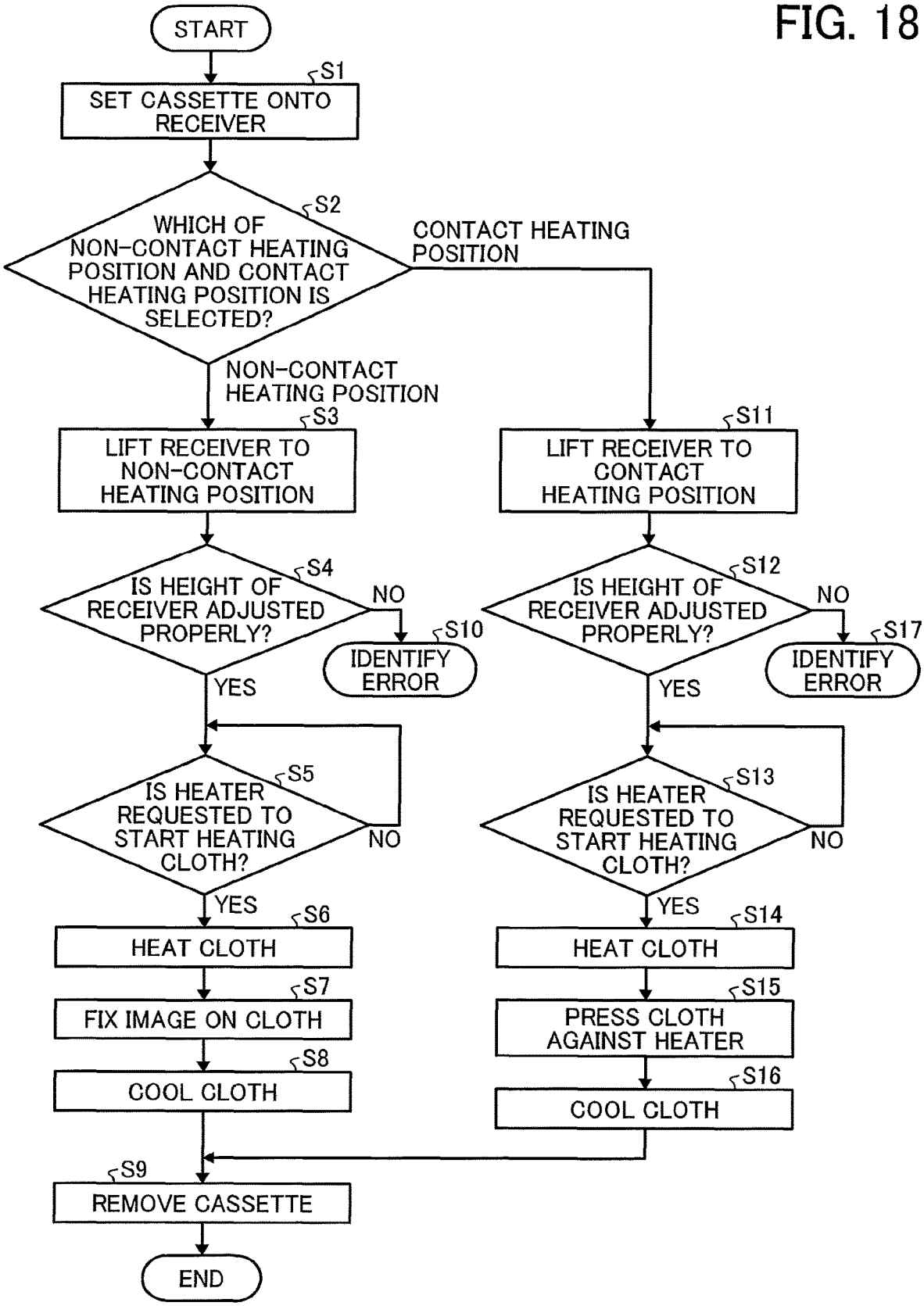
FIG. 18 is a flowchart of a control method for controlling the heating apparatus depicted in FIG. 16.

Referring to FIGS. 16 to 18, a description is provided of a construction of a heating apparatus 500F according to a seventh embodiment.

FIG. 16 is an external perspective view of the heating apparatus 500F. FIG. 17 is a block diagram of the heating apparatus 500F. FIG. 18 is a flowchart of a control method for controlling the heating apparatus 500F.

According to this embodiment, as illustrated in FIG. 16, the heating apparatus 500F includes a control panel 520 serving as an operation portion disposed above the front door 502. The control panel 520 includes a start key 521*a*, a fixing key 521*b* to specify the non-contact heating position, and a pressing key 521*c* to specify the contact heating position.

As an internal construction of the heating apparatus 500F, like the heating apparatus 500 according to the first embodiment depicted in FIGS. 8 to 10, the heating apparatus 500F incorporates the lift 507 including the jack 571 that is the pantograph type and the motor 572. The heating apparatus 500F does not incorporate the button 570. As illustrated in FIG. 17, the heating apparatus 500F includes a controller 2 (e.g., a processor) that is a central processing unit (CPU) provided with a random-access memory (RAM) and a read-only memory (ROM), for example. The controller 2 is operatively connected to the control panel 520, the distance sensor 573, the lift 507, and the heater 504.

Referring to FIG. 18, a description is provided of the control method for controlling the heating apparatus 500F that heats and fixes an image on the cloth 400.

In step S1, the user sets the cassette 200 mounting the cloth 400 onto the receiver 503 disposed inside the heating apparatus 500F. In order to fix the image on the cloth 400, the user presses the fixing key 521*b*. In order to press the cloth 400 against the heater 504 to eliminate creases on the cloth 400, the user presses the pressing key 521*c*.

In step S2, the controller 2 depicted in FIG. 17 determines which of the fixing key 521*b* to specify the non-contact heating position and the pressing key 521*c* to specify the contact heating position is selected.

If the controller 2 determines that the fixing key 521*b* to specify the non-contact heating position is pressed (NON-CONTACT HEATING POSITION in step S2), the controller 2 controls the lifts 507 to lift the receiver 503 to the non-contact heating position depicted in FIG. 15B where the cloth 400 is isolated from the heater 504 in step S3.

In step S4, the controller 2 determines whether the height of the receiver 503 is adjusted properly based on a detection result provided by the distance sensor 573, for example. If the controller 2 determines that the height of the receiver 503 is adjusted properly (YES in step S4), the controller 2 determines whether the start key 521*a* is pressed, that is, whether the heater 504 is requested to start heating the cloth 400, in step S5. Conversely, if the controller 2 determines that the height of the receiver 503 is not adjusted properly (NO in step S4), the controller 2 identifies an error in step S10.

If the controller 2 determines that the start key 521*a* is pressed (YES in step S5), the controller 2 controls the heater 504 to generate heat to increase the temperature of the cloth 400 in step S6. In step S7, the controller 2 causes the heater 504 to heat the cloth 400 for a predetermined fixing time that is arbitrarily specified to fix the image on the cloth 400.

When the predetermined fixing time elapses, the controller 2 controls the heater 504 to stop heating. In step S8, the cloth 400 is cooled for a predetermined time. In step S9, the user removes the cassette 200 from the heating apparatus 500F.

If the controller 2 determines that the pressing key 521*c* to specify the contact heating position is pressed (CONTACT HEATING POSITION in step S2), the controller 2 controls the lifts 507 to lift the receiver 503 to the contact heating position depicted in FIG. 15A where the cloth 400 contacts the heater 504 in step S11.

In step S12, the controller 2 determines whether the height of the receiver 503 is adjusted properly based on a detection result provided by the distance sensor 573, for example. If the controller 2 determines that the height of the receiver 503 is adjusted properly (YES in step S12), the controller 2 determines whether the start key 521*a* is pressed, that is, whether the heater 504 is requested to start heating the cloth 400, in step S13. Conversely, if the controller 2 determines that the height of the receiver 503 is not adjusted properly (NO in step S12), the controller 2 identifies an error in step S17. If the controller 2 determines that the start key 521*a* is pressed (YES in step S13), the controller 2 controls the heater 504 to generate heat to increase the temperature of the cloth 400 in step S14. In step S15, the controller 2 causes the cloth 400 to press against the heater 504 for a predetermined pressing time. In step S16, the cloth 400 is cooled for a predetermined time. In step S9, the user removes the cassette 200 from the heating apparatus 500F.

As described above, the receiver 503 is movable relative to the heater 504, downsizing the heating apparatus 500F and enhancing usability of the heating apparatus 500F to heat the cloth 400.

Referring to FIGS. 19 to 21, 22A, and 22B, a description is provided of a construction of a heating apparatus 500G according to an eighth embodiment.

Figure 19:
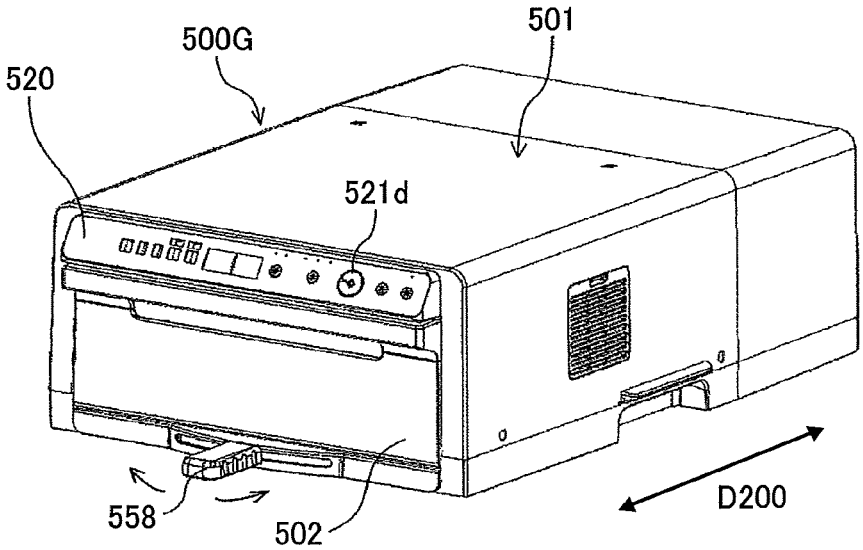
FIG. 19 is an external perspective view of a heating apparatus according to an eighth embodiment of the present disclosure.
Figure 20:
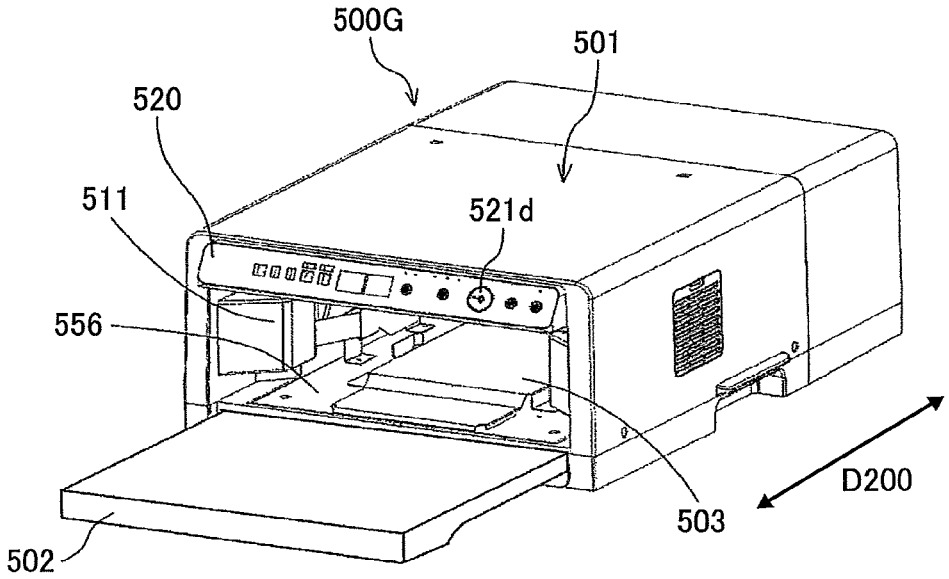
FIG. 20 is an external perspective view of the heating apparatus depicted in FIG. 19, illustrating the front door that is opened.
Figure 21:
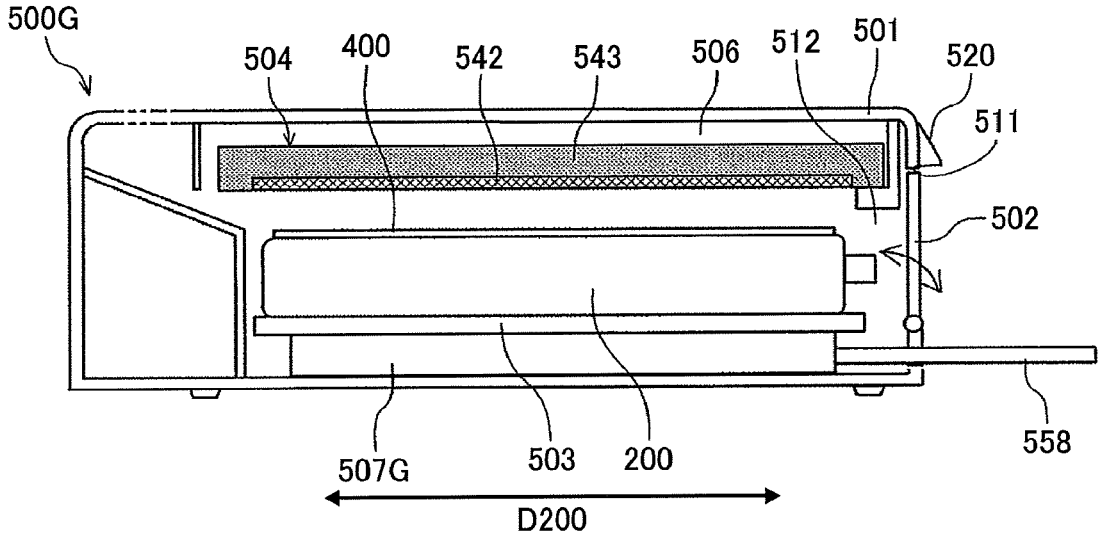
FIG. 21 is a cross-sectional view of the heating apparatus depicted in FIG. 20 in the attachment-detachment direction of the cassette.
Figure 22A:
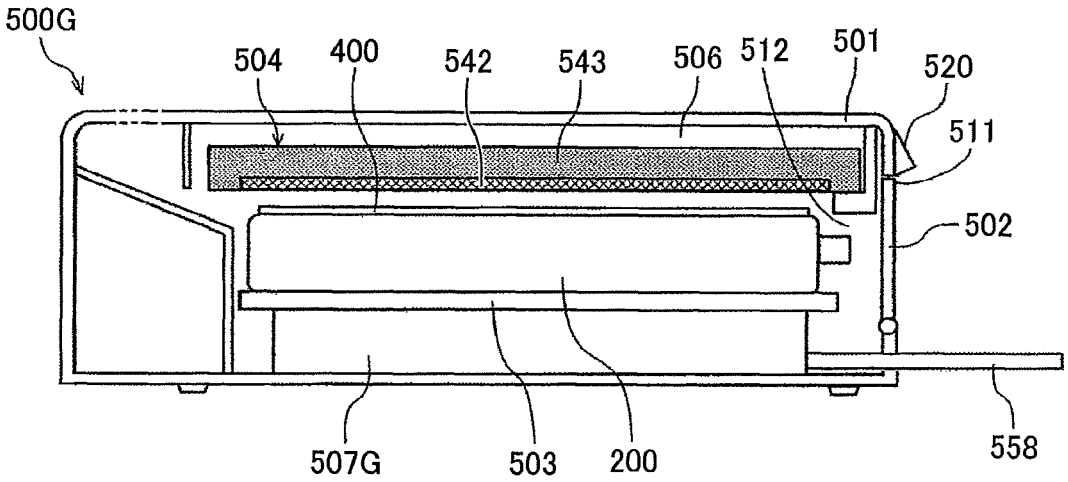
FIG. 22A is a cross-sectional view of the heating apparatus depicted in FIG. 20 in the attachment-detachment direction of the cassette, illustrating the non-contact heating position of the cloth.
Figure 22B:
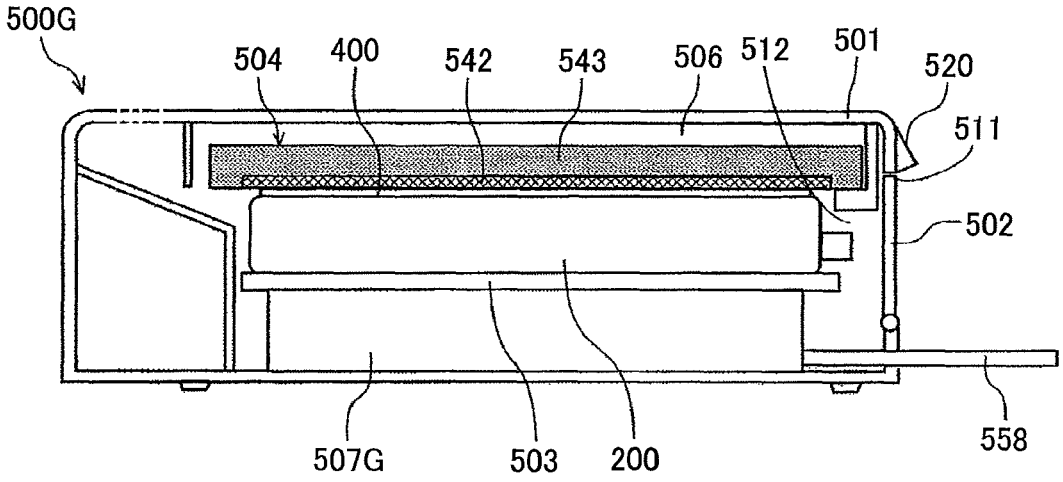
FIG. 22B is a cross-sectional view of the heating apparatus depicted in FIG. 20 in the attachment-detachment direction of the cassette, illustrating the contact heating position of the cloth.

FIG. 19 is an external perspective view of the heating apparatus 500G. FIG. 20 is an external perspective view of the heating apparatus 500G, illustrating the front door 502 that is opened. FIG. 21 is a cross-sectional view of the heating apparatus 500G in the attachment-detachment direction D200 of the cassette 200. FIG. 22A is a cross-sectional view of the heating apparatus 500G in the attachment-detachment direction D200 of the cassette 200, illustrating the non-contact heating position of the cloth 400. FIG. 22B is a cross-sectional view of the heating apparatus 500G in the attachment-detachment direction D200 of the cassette 200, illustrating the contact heating position of the cloth 400.

The heating apparatus 500G has a construction that is equivalent to the construction of the heating apparatus 500 according to the first embodiment depicted in FIG. 8 except for the lifts 507.

As illustrated in FIG. 21, the heating apparatus 500G includes a lift 507G that supports the receiver 503. The lift 507G serves as a relative mover, a mover, or a position switcher which moves, that is, lifts and lowers, the receiver 503 relative to the heater 504 in three levels vertically in FIG. 21 in which a relative distance from the receiver 503 to the heater 504 changes.

The lift 507G moves the receiver 503 relative to the heater 504 to three relative positions, that is, a standby position or a first position depicted in FIG. 21, the non-contact heating position or a second position depicted in FIG. 22A, and the contact heating position or a third position depicted in FIG. 22B. The relative distance from the receiver 503 to the heater 504 is greatest when the receiver 503 is at the standby position and shortest when the receiver 503 is at the contact heating position where the cloth 400 contacts the heater 504. The relative distance when the receiver 503 is situated at the non-contact heating position is greater than that when the receiver 503 is situated at the contact heating position.

The standby position depicted in FIG. 21 is a position that allows the user to insert the cassette 200 into the body 501 and remove the cassette 200 from the body 501. The non-contact heating position depicted in FIG. 22A is a heating position where the heater 504 heats the cloth 400 isolated from the heater 504. The contact heating position depicted in FIG. 22B is a heating position or a pressing position where the heater 504 heats the cloth 400 in contact with the heater 504.

As illustrated in FIG. 19, the control panel 520 includes a display and a plurality of keys with which the user inputs various instructions such as a preheating start key 521*d*.

Figure 23:
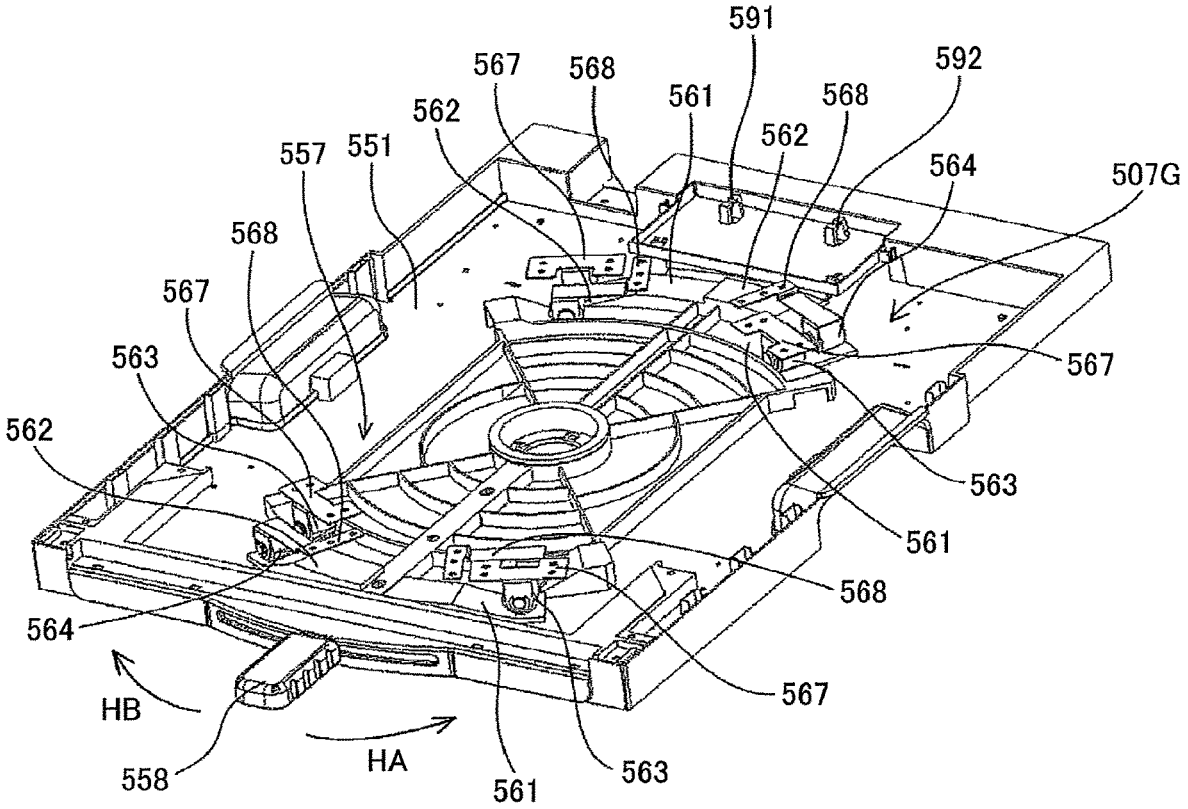
FIG. 23 is a perspective view of a lift incorporated in the heating apparatus depicted in FIG. 22B.
Figure 24:
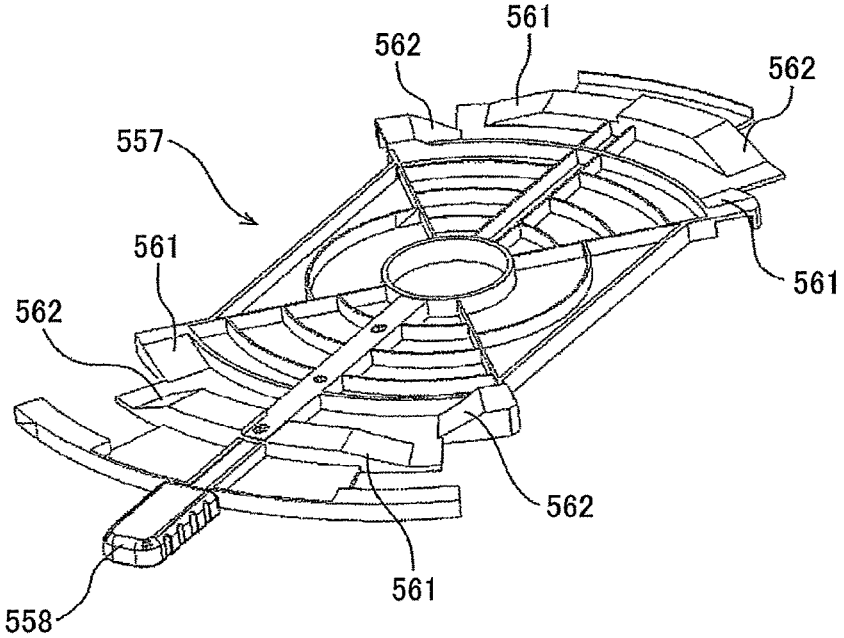
FIG. 24 is a perspective view of a cam assembly incorporated in the lift depicted in FIG. 23.

Referring to FIGS. 23 and 24, a description is provided of one example of a construction of the lift 507G incorporated in the heating apparatus 500G according to this embodiment.

FIG. 23 is a perspective view of the lift 507G. FIG. 24 is a perspective view of a cam assembly 557 incorporated in the lift 507G.

As illustrated in FIG. 21, the receiver 503 is held on the lift 507G.

The lift 507G includes a table 556 depicted in FIG. 20 that holds the receiver 503 and the cam assembly 557 depicted in FIG. 23 that moves the table 556 vertically.

As illustrated in FIG. 23, the cam assembly 557 includes a bottom plate 551 and a lever 558. The bottom plate 551 is disposed at a bottom of the body 501. The lever 558 serves as a position switch lever supported by the bottom plate 551 such that the lever 558 is pivotable horizontally. As illustrated in FIG. 24, the lever 558 mounts two bevel cams that have different heights, respectively, that is, a first bevel cam 561 and a second bevel cam 562. An uppermost face of the first bevel cam 561 is lower than an uppermost face of the second bevel cam 562.

As illustrated in FIG. 23, roller supports 567 and 568 are secured to a bottom face of the table 556. The roller support 567 rotatably supports a first roller 563 that follows the first bevel cam 561. The roller support 568 rotatably supports a second roller 564 that follows the second bevel cam 562. The table 556 is held on the cam assembly 557 through the first roller 563 and the second roller 564.

As illustrated in FIG. 23, as the user pivots the lever 558 in a direction HA from a standby position, that is, a center position, the first roller 563 held on the table 556 rolls up on the first bevel cam 561. Accordingly, the table 556 is lifted to the height of the first bevel cam 561 and the receiver 503 is lifted from the standby position to the non-contact heating position.

Similarly, as the user pivots the lever 558 in a direction HB from the standby position, that is, the center position, the second roller 564 held on the table 556 rolls up on the second bevel cam 562. Accordingly, the table 556 is lifted to the height of the second bevel cam 562 and the receiver 503 is lifted from the standby position to the contact heating position.

As described above, as the user moves the lever 558, the table 556 moves vertically, changing the height of the cassette 200 placed on the receiver 503 held by the table 556 and therefore changing a gap (e.g., a relative distance) between the cloth 400 and the heater 504 or pressure with which the cloth 400 is pressed against the heater 504.

As illustrated in FIG. 23, the cam assembly 557 further includes a first detector 591 and a second detector 592. When the user pivots the lever 558 in the direction HA until the receiver 503 reaches the non-contact heating position, the first detector 591 detects the lever 558. When the user pivots the lever 558 in the direction HB until the receiver 503 reaches the contact heating position, the second detector 592 detects the lever 558.

When the user presses the preheating start key 521*d* depicted in FIG. 19, power is supplied to the heater 504 to start preheating. When the heating apparatus 500G is heated to a target temperature, the heating apparatus 500G notifies the user of completion of preheating. For example, the preheating start key 521*d* blinks to notify completion of preheating.

After preheating is completed, the user sets the cassette 200 mounting the cloth 400 onto the receiver 503 disposed inside the heating apparatus 500G and pivots the lever 558 to a desired position.

When the first detector 591 detects that the receiver 503 moves to the non-contact heating position after the user pivots the lever 558 or when the second detector 592 detects that the receiver 503 moves to the contact heating position, the controller 2 controls the heater 504 to start heating the cloth 400.

Figure 25:
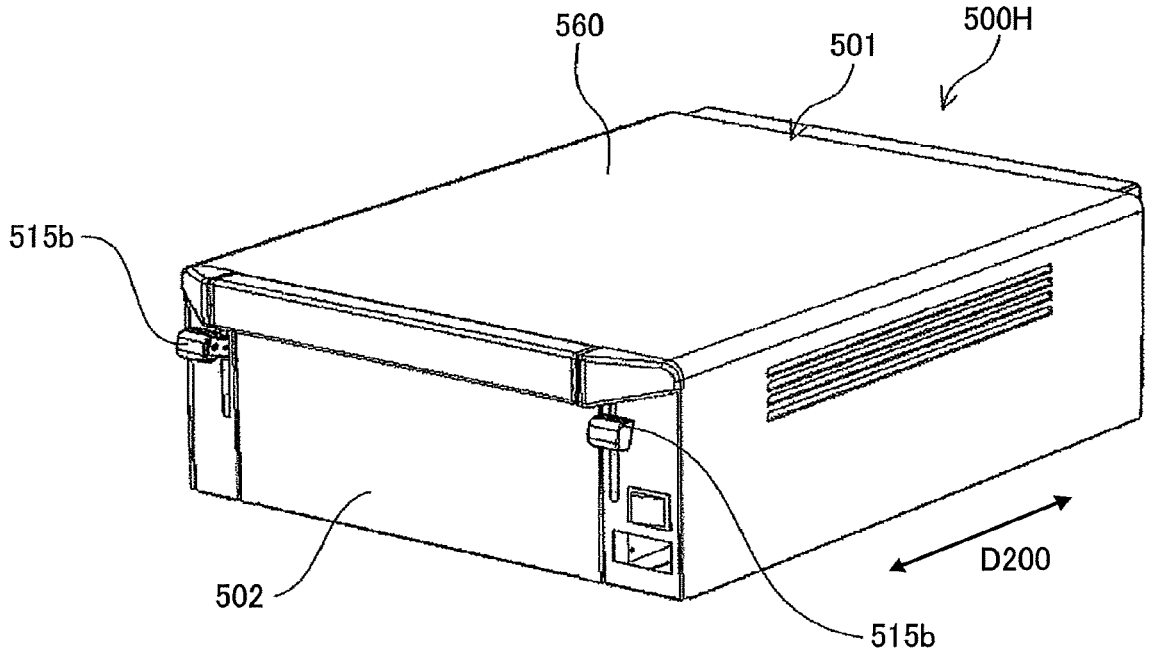
FIG. 25 is an external perspective view of a heating apparatus according to a ninth embodiment of the present disclosure.
Figure 26:
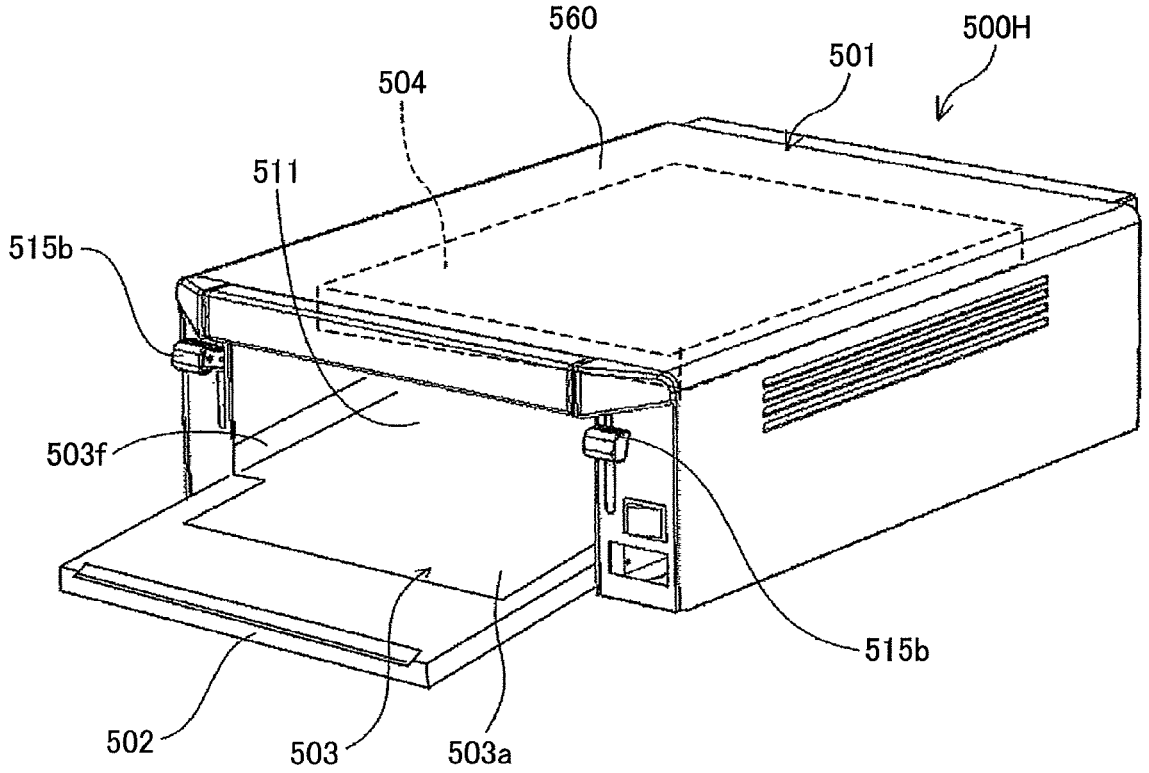
FIG. 26 is an external perspective view of the heating apparatus depicted in FIG. 25, illustrating the front door that is opened.

Referring to FIGS. 25 and 26, a description is provided of a construction of a heating apparatus 500H according to a ninth embodiment.

FIG. 25 is an external perspective view of the heating apparatus 500H. FIG. 26 is an external perspective view of the heating apparatus 500H, illustrating the front door 502 that is opened.

As illustrated in FIG. 26, like the heating apparatuses 500, 500A, 500B, 500C, 500D, 500E, 500F, and 500G according to the embodiments described above, the heating apparatus 500H includes the body 501 and the front door 502 (e.g., a front cover). The front door 502 serving as a door is disposed at the front of the body 501 and is opened and closed to expose and cover the opening 511. The cassette 200 is inserted into and removed from the body 501 through the opening 511. An exterior cover 560 is attached to the body 501.

Inside the body 501 is the receiver 503 serving as a cassette mount that removably holds the cassette 200 serving as a cloth holder or a holder that holds the cloth 400 bearing an image.

Above the receiver 503 is the heater 504 that is disposed opposite the receiver 503 and heats the cloth 400 held by the cassette 200. According to this embodiment, the heater 504 is movable vertically relative to the receiver 503.

In order to use the heating apparatus 500H, for example, before the printer 1 prints an image on the cloth 400, the user sets the cassette 200 mounting the cloth 400 onto the receiver 503, lowers the heater 504 to come into contact with the cloth 400, and causes the heater 504 to heat the cloth 400 while the heater 504 presses against the cloth 400 in a pre-process (e.g., a pressing process).

After the printer 1 prints the image on the cloth 400, the user removes the cassette 200 from the printer 1, sets the cassette 200 onto the receiver 503 of the heating apparatus 500H, lowers the heater 504 to the non-contact heating position where the heater 504 is isolated from the cloth 400, and causes the heater 504 to heat the cloth 400 isolated from the heater 504, thus fixing the image on the cloth 400.

Figure 27:
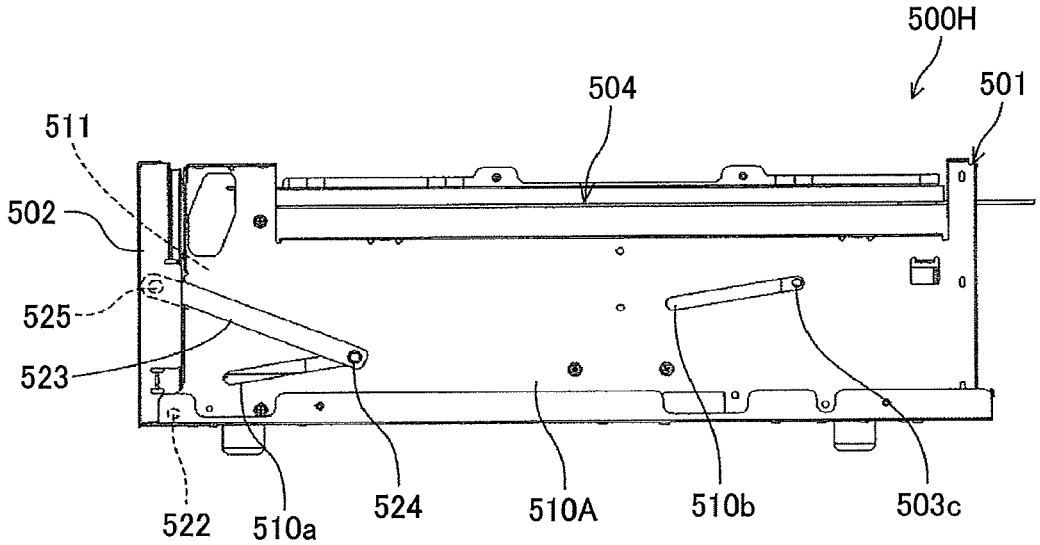
FIG. 27 is an internal cross-sectional side view of the heating apparatus depicted in FIG. 25, illustrating the front door that is closed.
Figure 28:
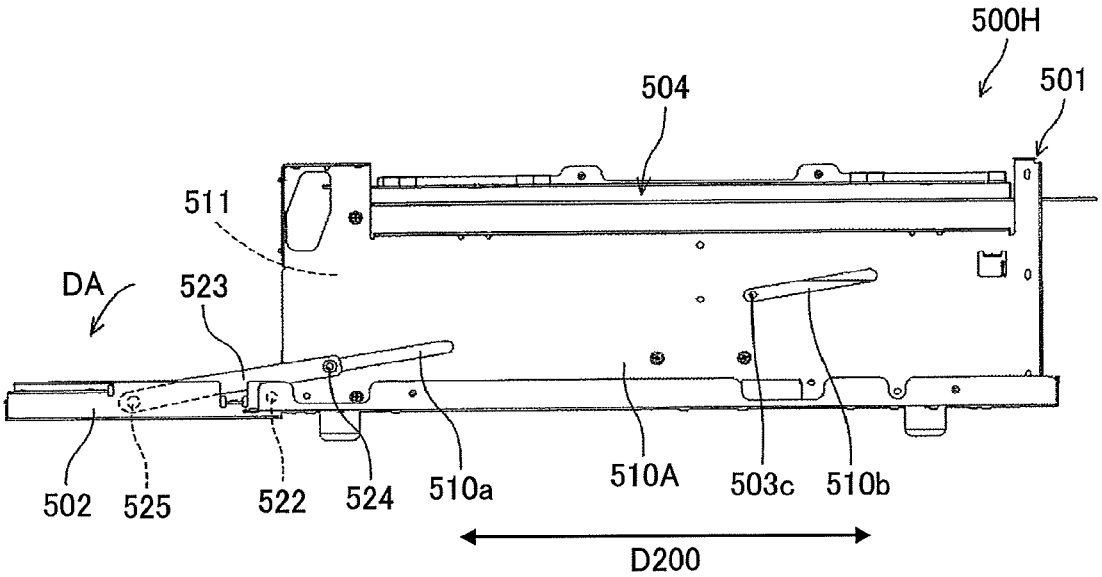
FIG. 28 is an internal cross-sectional side view of the heating apparatus depicted in FIG. 26, illustrating the front door that is opened.

Referring to FIGS. 27 and 28, a description is provided of the construction of the heating apparatus 500H in detail.

Referring to FIGS. 27 and 28, a description is now given of motion of the front door 502 (e.g., the front cover).

FIG. 27 is an internal cross-sectional side view of the heating apparatus 500H, illustrating the front door 502 that is closed. FIG. 28 is an internal cross-sectional side view of the heating apparatus 500H, illustrating the front door 502 that is opened. FIGS. 27 and 28 illustrate the heating apparatus 500H from which the exterior cover 560 is removed.

As illustrated in FIGS. 26 to 28, the front door 502 is opened and closed. The front door 502 is opened in a direction DA depicted in FIG. 28 and opened flat as illustrated in FIGS. 26 and 28.

As illustrated in FIG. 28, the front door 502 is pivotable about a shaft 522 and opened and closed relative to the opening 511 of the body 501. One end of an arm 523 is attached to an interior side face of the front door 502. The arm 523 is pivotable about a shaft 525. A link shaft 524 is attached to another end of the arm 523.

Figure 29:
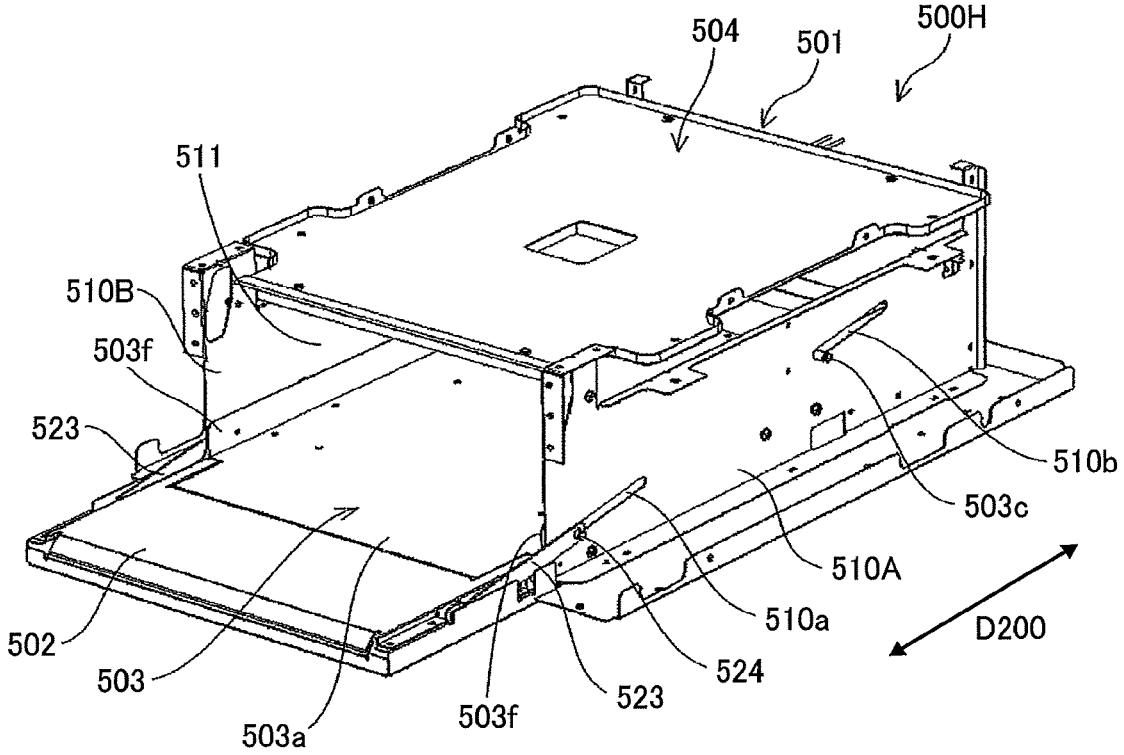
FIG. 29 is an internal perspective view of the heating apparatus depicted in FIG. 28, illustrating the front door that is opened.

The body 501 includes a right side plate 510A and a left side plate 510B depicted in FIG. 29 that construct a frame. Each of the right side plate 510A and the left side plate 510B is hereinafter referred to as a side plate 510 if the right side plate 510A is not distinguished from the left side plate 510B. The side plate 510 includes a guiding hole 510*a* (e.g., an elongate hole) extended substantially in the attachment-detachment direction D200 of the cassette 200 and inclined downward toward the front of the body 501. The link shaft 524 attached to the arm 523 movably engages the guiding hole 510*a*.

As the front door 502 closed as illustrated in FIG. 27 is pivoted in the direction DA and opened as illustrated in FIG. 28, the link shaft 524 moves obliquely downward toward the front of the body 501 along the guiding hole 510*a* extended obliquely, thus moving the arm 523.

Figure 30:
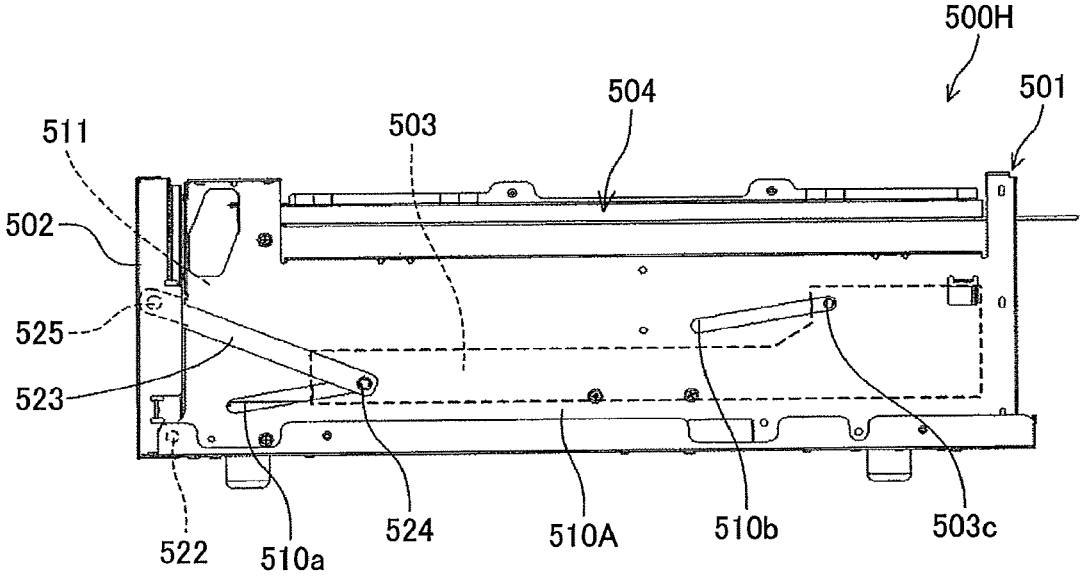
FIG. 30 is an internal cross-sectional side view of the heating apparatus depicted in FIG. 27, illustrating the front door that is closed.
Figure 31:
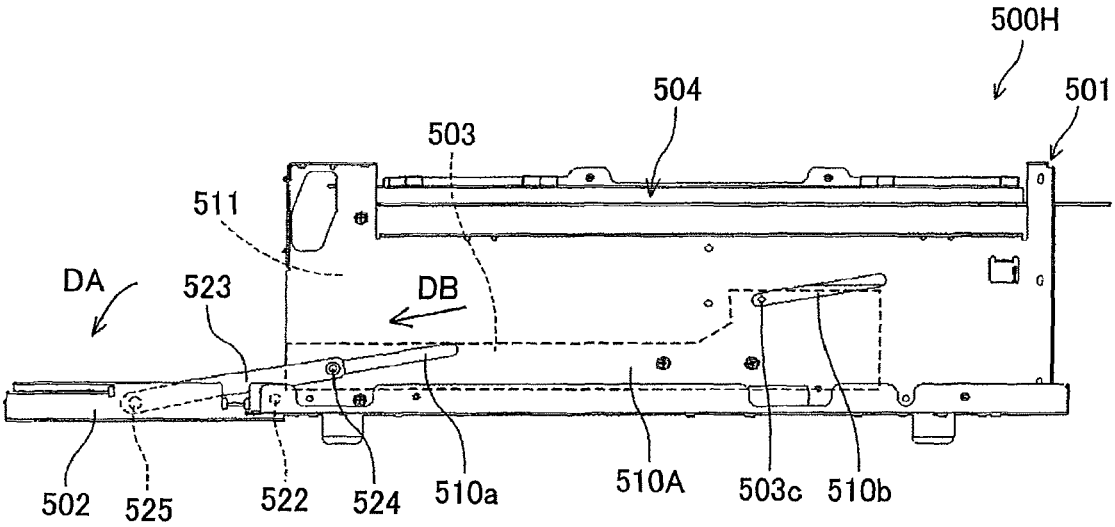
FIG. 31 is an internal cross-sectional side view of the heating apparatus depicted in FIG. 28, illustrating the front door that is opened.

Referring to FIGS. 29 to 31, a description is provided of a construction of an interlock between the front door 502 and the receiver 503.

FIG. 29 is an internal perspective view of the heating apparatus 500H, illustrating the front door 502 that is opened. FIG. 30 is an internal cross-sectional side view of the heating apparatus 500H, illustrating the front door 502 that is closed. FIG. 31 is an internal cross-sectional side view of the heating apparatus 500H, illustrating the front door 502 that is opened.

As illustrated in FIG. 29, the receiver 503 is interposed between the right side plate 510A and the left side plate 510B of the body 501 such that the receiver 503 is movable vertically and horizontally in the attachment-detachment direction D200, that is, in a front-back direction from a front to a rear and from the rear to the front of the heating apparatus 500H. According to this embodiment, the receiver 503 is movable obliquely, thus being movable vertically and in the front-back direction.

As illustrated in FIG. 29, the link shaft 524 attached to the arm 523 attached to the front door 502 is coupled with a front of a flange 503*f* in the attachment-detachment direction D200 of the cassette 200. The flange 503*f* is disposed at each lateral end of the receiver 503 in a direction perpendicular to the attachment-detachment direction D200 of the cassette 200.

A guiding hole 510*b* (e.g., an elongate hole) is disposed at a rear part of the side plate 510 of the body 501 in the attachment-detachment direction D200 of the cassette 200. The guiding hole 510*b* is inclined downward toward the front of the body 501 in the attachment-detachment direction D200 of the cassette 200.

A guiding shaft 503*c* is disposed rearward from the flange 503*f* of the receiver 503 and movably engages the guiding hole 510*b*.

Accordingly, as the front door 502 is opened and closed, the link shaft 524 moves along the guiding hole 510*a*. Since the link shaft 524 is coupled with the receiver 503, as the link shaft 524 and the guiding shaft 503*c* move along the guiding holes 510*a* and 510*b*, respectively, the receiver 503 coupled with the link shaft 524 moves vertically and in the front-back direction in accordance with opening and closing of the front door 502.

For example, as illustrated in FIG. 30, when the front door 502 is closed, the receiver 503 moves upward while moving rearward to a first position. As illustrated in FIG. 31, when the front door 502 is opened, the receiver 503 moves downward while moving frontward in a direction DB from the first position to a second position below the first position.

As described above, a heating apparatus (e.g., the heating apparatus 500H) includes a receiver (e.g., the receiver 503) and a heater (e.g., the heater 504). The receiver removably holds a holder (e.g., the cassette 200) mounting a heating object (e.g., the cloth 400). The heater heats the heating object. The receiver interlocked with a door (e.g., the front door 502) moves vertically relative to the heater as the door is opened and closed. Accordingly, the heater heats the heating object while the heating object is held by the holder, enhancing usability of the user who sets the holder inside the heating apparatus.

Figure 32:
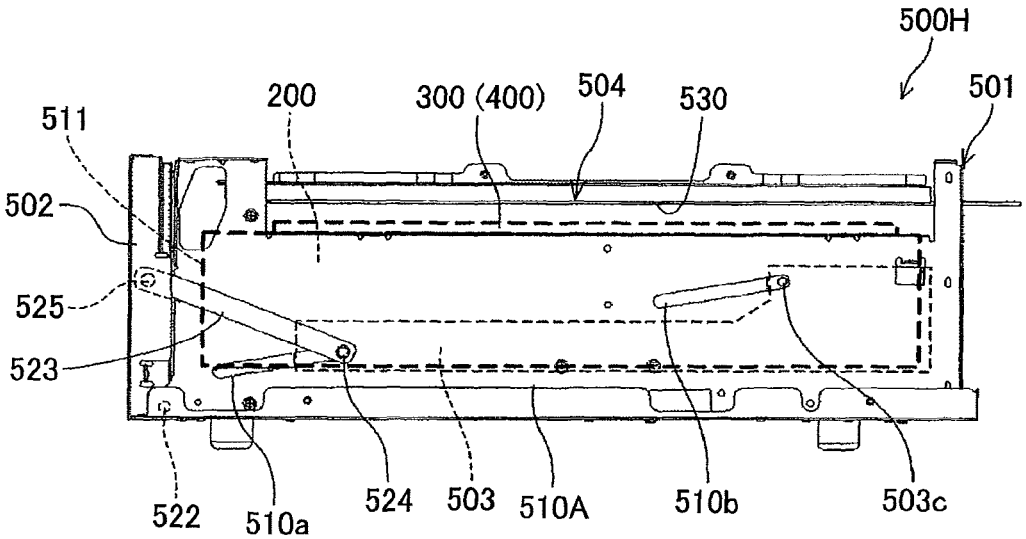
FIG. 32 is an internal cross-sectional side view of the heating apparatus depicted in FIG. 30, illustrating the front door that is closed.
Figure 33:
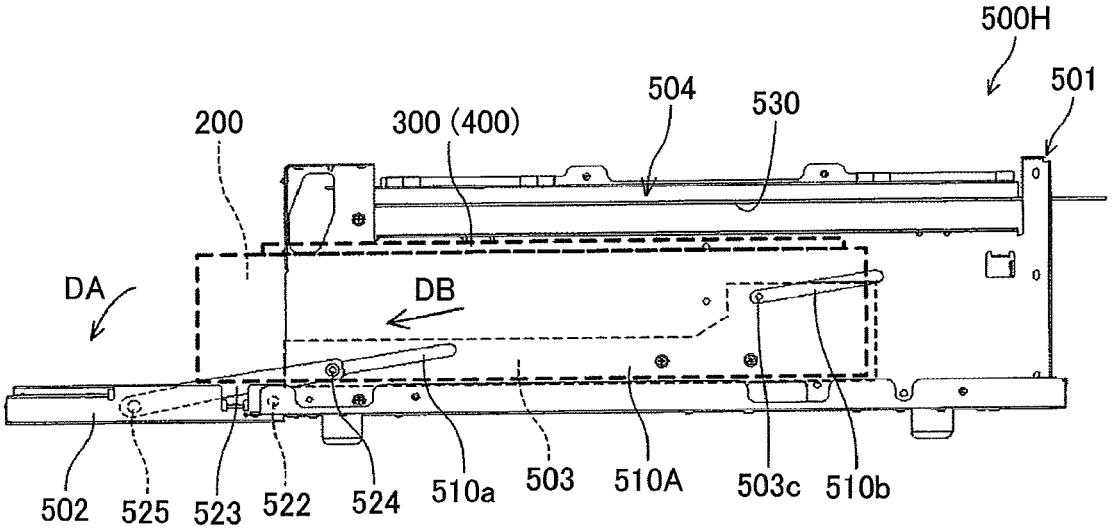
FIG. 33 is an internal cross-sectional side view of the heating apparatus depicted in FIG. 31, illustrating the front door that is opened.

Referring to FIGS. 32 and 33, a description is provided of setting of the cassette 200 on the receiver 503 inside the heating apparatus 500H.

FIG. 32 is an internal cross-sectional side view of the heating apparatus 500H, illustrating the front door 502 that is closed. FIG. 33 is an internal cross-sectional side view of the heating apparatus 500H, illustrating the front door 502 that is opened.

As described above, the receiver 503 interlocked with the front door 502 moves between the first position and the second position in accordance with opening and closing of the front door 502.

Accordingly, as illustrated in FIG. 33, the user opens the front door 502 to move the receiver 503 to the second position lower than the first position and places the cassette 200 mounting the cloth 400 onto the receiver 503, thus setting the cassette 200 on the receiver 503.

Subsequently, as illustrated in FIG. 32, the user closes the front door 502 to move the receiver 503 from the second position to the first position where the cassette 200 is disposed in proximity to a heating face 530 of the heater 504. Thus, the heater 504 heats the cloth 400 on the cassette 200 effectively.

Thereafter, as the user opens the front door 502, the cassette 200 mounted on the receiver 503 moves obliquely downward toward the front of the body 501 as illustrated in FIG. 33. Hence, the cloth 400 set on the cassette 200 is isolated from the heater 504 with a sufficient interval therebetween and the cassette 200 moves toward the front of the body 501.

As described above, the receiver 503 interlocked with the front door 502 moves in accordance with opening and closing of the front door 502. Accordingly, while the front door 502 is closed, the heater 504 heats the cloth 400 on the cassette 200. While the front door 502 is opened, the user attaches the cassette 200 to the receiver 503 or detaches the cassette 200 from the receiver 503.

Consequently, the heater 504 does not scratch the surface of the cloth 400 set on the cassette 200, allowing the user to attach the cassette 200 to the receiver 503 and detach the cassette 200 from the receiver 503 readily.

Figure 34:
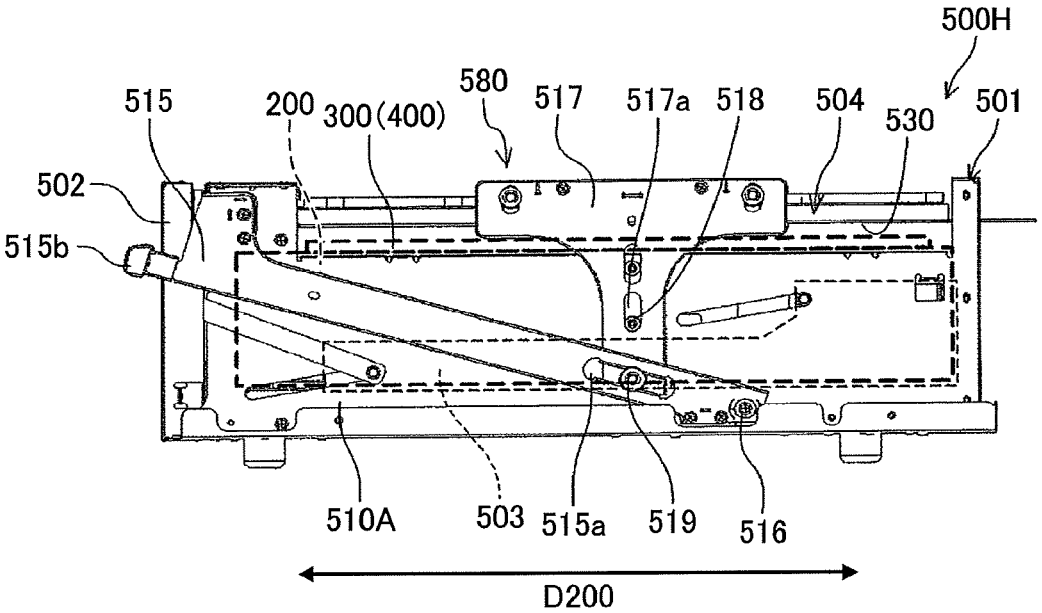
FIG. 34 is a cross-sectional side view of the heating apparatus depicted in FIG. 32, illustrating the non-contact heating position of the heater.
Figure 35:
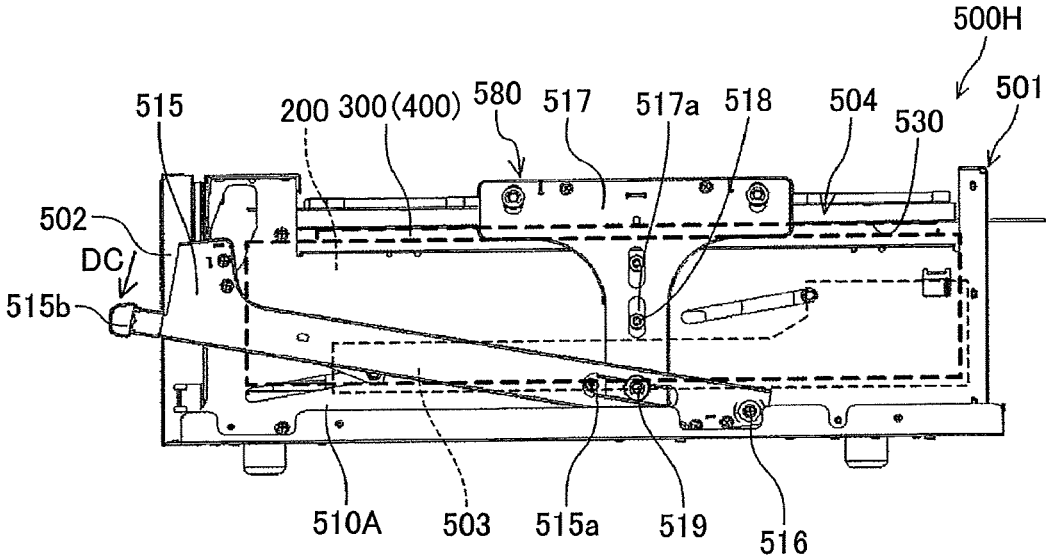
FIG. 35 is a cross-sectional side view of the heating apparatus depicted in FIG. 32, illustrating the contact heating position of the heater.
Figure 36:
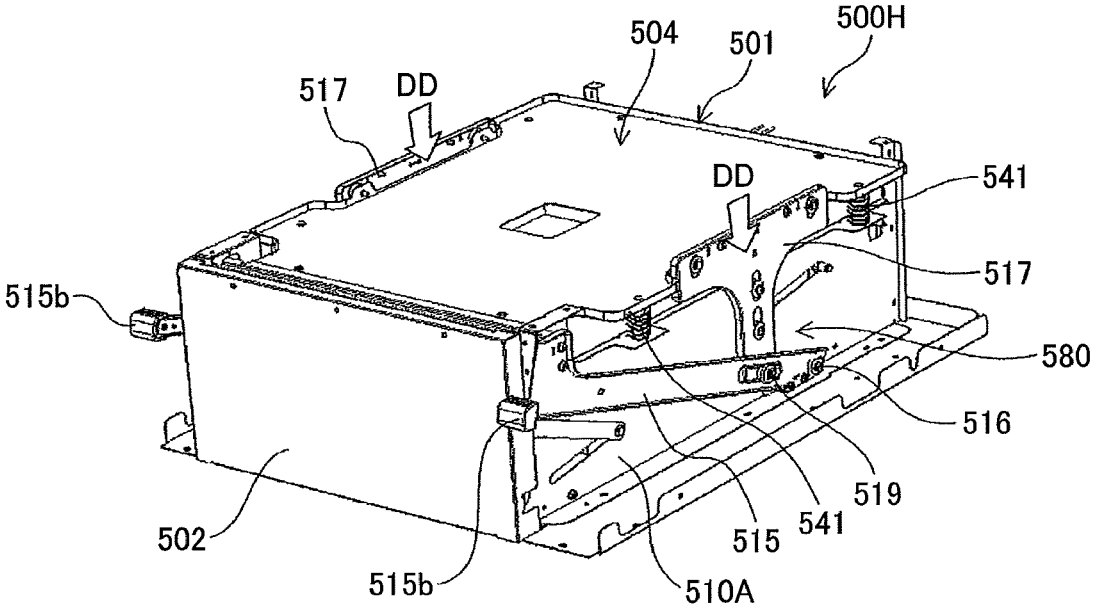
FIG. 36 is an internal perspective view of the heating apparatus depicted in FIG. 34, illustrating the non-contact heating position of the heater.

Referring to FIGS. 34 to 36, a description is provided of a construction of a lift 580 that moves the heater 504 vertically.

FIG. 34 is a cross-sectional side view of the heating apparatus 500H, illustrating the non-contact heating position of the heater 504 where the heater 504 is isolated from the cloth 400. FIG. 35 is a cross-sectional side view of the heating apparatus 500H, illustrating the contact heating position of the heater 504 where the heater 504 is in contact with the cloth 400. FIG. 36 is an internal perspective view of the heating apparatus 500H, illustrating the non-contact heating position of the heater 504. FIG. 25 illustrating the external perspective view of the heating apparatus 500H is also referred.

As illustrated in FIG. 34, the heating apparatus 500H includes the lift 580 serving as a relative mover or a mover that moves the heater 504 relative to the receiver 503 vertically while the front door 502 is closed.

The lift 580 includes a lever 515 and a coupler 517. The lever 515 is disposed outside the exterior cover 560 of the body 501 to allow the user to operate the lever 515. The coupler 517 supports the heater 504 and couples the lever 515 with the heater 504. The coupler 517 moves vertically in accordance with motion of the lever 515.

For example, the lever 515 is pivotally supported by the side plate 510, that is, each of the right side plate 510A and the left side plate 510B, of the body 501 such that the lever 515 is pivotable about a shaft 516 serving as a fulcrum.

A front end of the lever 515 in the attachment-detachment direction D200 of the cassette 200 projects beyond the exterior cover 560 of the body 501. As illustrated in FIGS. 25 and 34, a catch 515*b* serving as an operation portion accessed by the user is disposed on the front end of the lever 515 that projects beyond the exterior cover 560.

The catch 515*b* of the lever 515 is disposed outboard from the front door 502 in a direction perpendicular to the attachment-detachment direction D200 of the cassette 200. The catch 515*b* is attached to the front end of the lever 515 that projects beyond the exterior cover 560 in the attachment-detachment direction D200 of the cassette 200.

Accordingly, while the front door 502 is closed, the user moves the catch 515*b* of the lever 515, thus moving the lever 515.

As illustrated in FIG. 34, the coupler 517 having a T-shape is disposed on the side plate 510, that is, each of the right side plate 510A and the left side plate 510B, of the body 501 such that the coupler 517 is movable vertically. The coupler 517 includes two guiding holes 517*a* (e.g., elongate holes) that are elongated vertically. A shaft 518 mounted on the side plate 510 movably engages the guiding hole 517*a*.

An upper portion of the coupler 517 supports each lateral end of the heater 504 in the direction perpendicular to the attachment-detachment direction D200 of the cassette 200. As illustrated in FIG. 36, a spring 541 is interposed between the heater 504 and each of the right side plate 510A and the left side plate 510B of the body 501.

As illustrated in FIG. 34, the lever 515 includes a guiding hole 515*a* (e.g., an elongate hole) that is disposed closer to the front door 502 than the shaft 516 is in the attachment-detachment direction D200 of the cassette 200. A shaft 519 mounted on the coupler 517 movably engages the guiding hole 515*a*.

Accordingly, as illustrated in FIG. 34, when the user moves the catch 515*b* of the lever 515 serving as an operation portion to a first operation position, that is, when the user does not press down the lever 515 according to this embodiment, the lever 515 is lifted and therefore the heater 504 moves to the non-contact heating position where the heating face 530 of the heater 504 is isolated from the cloth 400 on the cassette 200 held by the receiver 503.

Hence, the heater 504 heats and dries the cloth 400 held on the cassette 200 while the heater 504 is isolated from the cloth 400. An interval between the cloth 400 and the heating face 530 of the heater 504 is in a range of from about 1 mm to about 4 mm to dry the cloth 400 efficiently.

Conversely, as illustrated in FIG. 35, when the user moves the catch 515*b* of the lever 515 serving as an operation portion to a second operation position, that is, when the user presses down the catch 515*b* of the lever 515 in a direction DC according to this embodiment, the lever 515 pivots about the shaft 516 in the direction DC and therefore the coupler 517 lowers in a direction DD depicted in FIG. 36.

Accordingly, the heater 504 lowers to the contact heating position depicted in FIG. 35 where the heating face 530 of the heater 504 contacts the cloth 400 held by the cassette 200 attached to the receiver 503.

Consequently, the heating face 530 of the heater 504 presses against the cloth 400 held by the cassette 200, causing the heater 504 to heat the cloth 400 under pressure.

As a result, before the printing process in which the printer 1 prints an image on the cloth 400, the heater 504 presses against the cloth 400 held by the cassette 200 and eliminates creases of the cloth 400. Alternatively, in order to increase pressure exerted by the heater 504 to the cloth 400, the heating apparatus 500H may employ a layout in which the second operation position defines a position where the heating face 530 of the heater 504 engages the platen 300 of the cassette 200.

When the user releases pressure exerted on the catch 515*b* of the lever 515 after the user presses down the catch 515*b*, a biasing force of the spring 541 lifts and returns the heater 504 to the non-contact heating position depicted in FIG. 34 where the heater 504 is isolated from the cloth 400 held by the cassette 200.

As the heater 504 is lifted, the lever 515 also returns to the non-contact heating position depicted in FIG. 34. Accordingly, since the user separates his or her hand from the lever 515 when the user opens the front door 502, the heating face 530 of the heater 504 does not scratch the cloth 400 held by the cassette 200.

As described above, since the user moves the catch 515*b* of the lever 515 while the front door 502 is closed, the user moves the heater 504 vertically, that is, lifts and lowers the heater 504, between the contact heating position and the non-contact heating position while the front door 502 is closed.

As described above, the heating apparatus 500H includes the lift 580 serving as an operation portion or a lift that vertically moves the heater 504 disposed inside the body 501 while the front door 502 serving as a door is closed. Accordingly, the heating apparatus 500H enhances usability of the user who sets the cassette 200 inside the heating apparatus 500H that presses and heats the cloth 400 held on the cassette 200 and usability of the user who sets the cassette 200 inside the printer 1 that prints an image on the cloth 400 held by the cassette 200.

Figure 37:
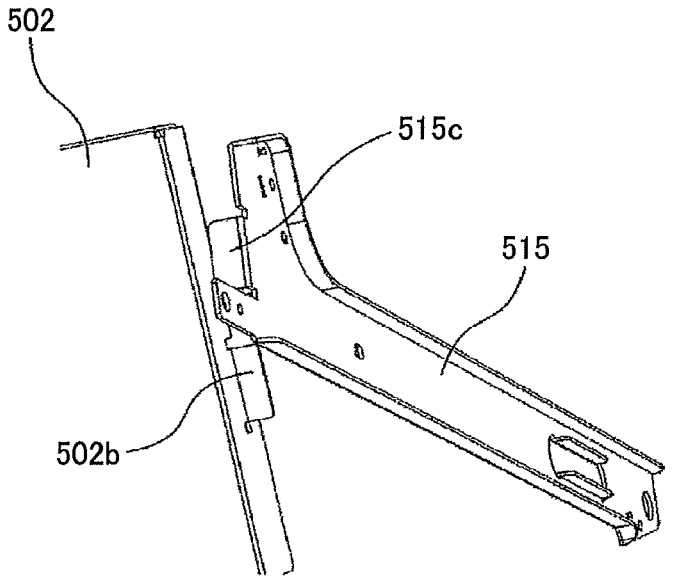
FIG. 37 is a perspective view of a lever and the front door incorporated in the heating apparatus depicted in FIG. 36, illustrating the lever situated at an upper position.
Figure 38:
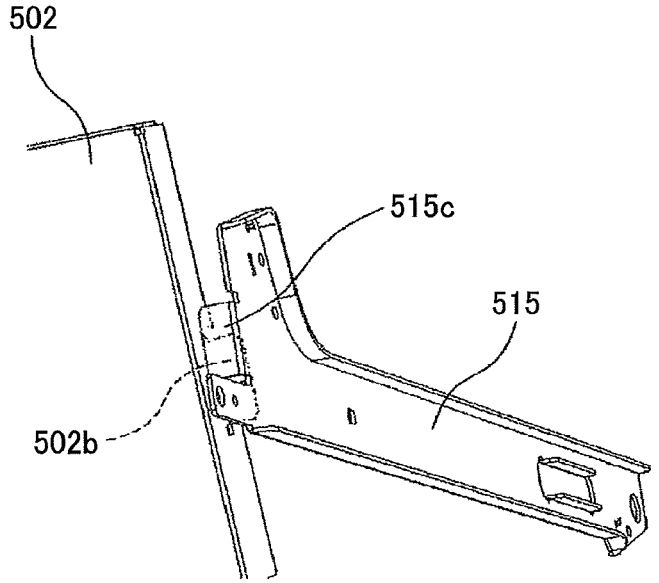
FIG. 38 is a perspective view of the lever and the front door depicted in FIG. 37, illustrating the lever situated at a lower position.

Referring to FIGS. 37 and 38, a description is provided of a relation between the lever 515 and the front door 502.

FIG. 37 is a perspective view of the lever 515 and the front door 502, illustrating the lever 515 situated at an upper position. FIG. 38 is a perspective view of the lever 515 and the front door 502, illustrating the lever 515 situated at a lower position. Illustration of the catch 515*b* is omitted.

As illustrated in FIGS. 37 and 38, the lever 515 includes a flange 515*c*. The front door 502 includes a flange 502*b*. While the heater 504 is situated at the contact heating position depicted in FIG. 35, the flanges 515*c* and 502*b* depicted in FIG. 37 serve as a restrictor that restricts motion of the front door 502 serving as a door to an open position where the front door 502 is opened.

As illustrated in FIG. 37, while the lever 515 is lifted, that is, while the heater 504 is situated at the first operation position depicted in FIG. 34, the flange 515*c* of the lever 515 does not interfere with the flange 502*b* of the front door 502, thus allowing the user to open the front door 502.

Conversely, as illustrated in FIG. 38, while the lever 515 is lowered, that is, while the heater 504 is situated at the second operation position depicted in FIG. 35, the flange 515*c* of the lever 515 interferes with the flange 502*b* of the front door 502, thus prohibiting the user from opening the front door 502.

Hence, while the heater 504 is lowered, that is, while the heater 504 is situated at the contact heating position depicted in FIG. 35, the user is not capable of opening the front door 502.

Accordingly, when the user opens the front door 502, the heater 504 has moved to the non-contact heating position depicted in FIG. 34. Hence, when the user inserts the cassette 200 into the body 501 and removes the cassette 200 from the body 501, the heater 504 does not scratch the print face of the cloth 400.

Figure 39:
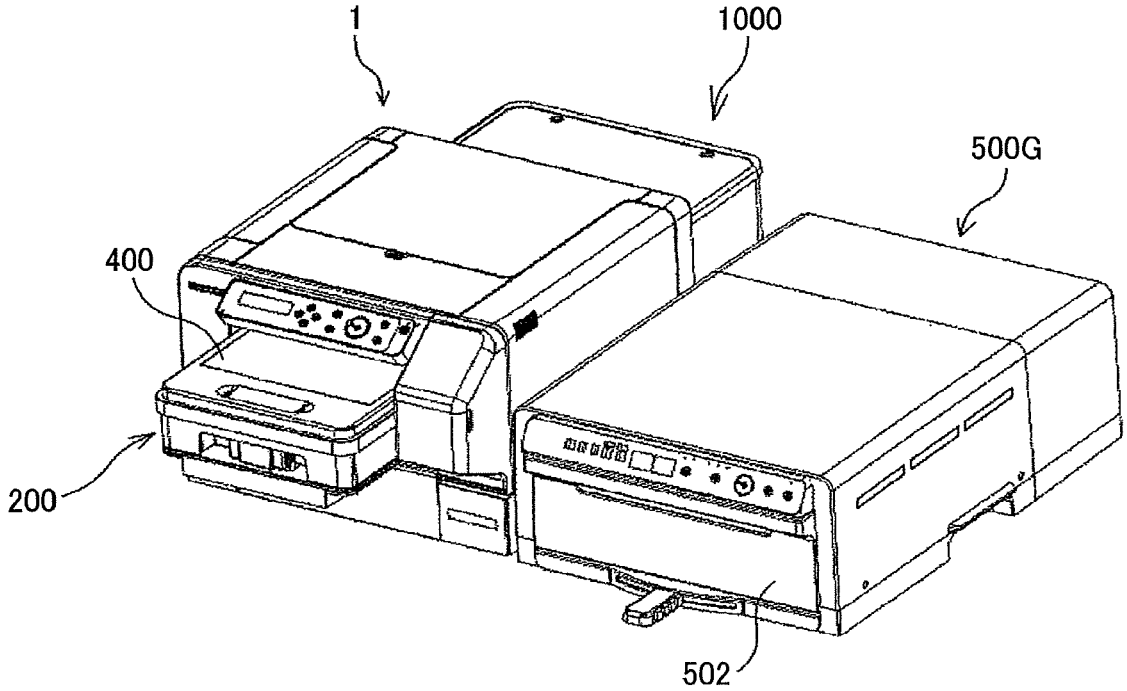
FIG. 39 is a perspective view of an image forming apparatus incorporating the printer depicted in FIG. 1 and the heating apparatus depicted in FIG. 19.

Referring to FIG. 39, a description is provided of a construction of an image forming apparatus 1000 (e.g., an image forming system) according to a tenth embodiment.

FIG. 39 is a perspective view of the image forming apparatus 1000, illustrating one example of usage of the image forming apparatus 1000.

As illustrated in FIG. 39, the image forming apparatus 1000 includes the cassette 200, the printer 1, and the heating apparatus 500G.

The cassette 200 is removably attached to the printer 1. The printer 1 prints an image on the cloth 400 serving as a printing object or a print medium held by the cassette 200.

As described above in the embodiments, the heating apparatus 500G removably accommodates the cassette 200. The heating apparatus 500G accommodates the cassette 200 mounting the cloth 400 and heats and fixes an image on the cloth 400. The image forming apparatus 1000 includes the heating apparatus 500G according to the eighth embodiment. Alternatively, the image forming apparatus 1000 may include any one of the heating apparatuses 500, 500A, 500B, 500C, 500D, 500E, 500F, and 500H according to other embodiments.

In the image forming apparatus 1000, the printer 1 is separately provided from the heating apparatus 500G. For example, the printer 1 is aligned with the heating apparatus 500G. Alternatively, the printer 1 may be stacked on the heating apparatus 500G or the heating apparatus 500G may be stacked on the printer 1. The printer 1 may be spaced apart from the heating apparatus 500G. If the printer 1 is stacked on the heating apparatus 500G or the heating apparatus 500G is stacked on the printer 1, the image forming apparatus 1000 decreases the area occupied by the printer 1 and the heating apparatus 500G.

In order to cause the image forming apparatus 1000 to form an image on the cloth 400, the user sets or attaches the cassette 200 to the stage 111 inside the printer 1 so that the printer 1 prints the image on the cloth 400.

When the printer 1 finishes printing the image on the cloth 400, the user removes the cassette 200 mounting the cloth 400 from the printer 1. The user opens the front door 502 (e.g., the front cover) serving as a door of the heating apparatus 500G. The user sets the cassette 200 mounting the cloth 400 bearing the image onto the receiver 503 disposed inside the heating apparatus 500G. The user closes the front door 502 and the heating apparatus 500G heats the cassette 200 and the cloth 400 on the cassette 200. As the heating apparatus 500G heats the cloth 400, the heating apparatus 500G fixes the image printed on the cloth 400.

A description is provided of processes for forming an image on a cloth 400.

In a holding process, the cassette 200 serving as a holder or a cloth holder holds a cloth 400 onto which an image is to be formed. In a printing process, the image is printed on the cloth 400 held by the cassette 200. In a heating process, after the printing process, the cassette 200 mounting the cloth 400 is removed from the printer 1 and attached to the receiver 503 depicted in FIG. 20 of the heating apparatus 500G. The heating apparatus 500G heats the cloth 400 and fixes the image on the cloth 400.

Thus, the cassette 200 serving as a holder or a cloth holder is used in both the printer 1 and the heating apparatus 500G. Accordingly, the user sets the cassette 200 mounting the cloth 400, as the cassette 200 mounts the cloth 400 in the printing process, inside the heating apparatus 500G. Even if the user carries the cassette 200 mounting the cloth 400, the cloth 400 is immune from creasing or partial overlapping that may degrade the print face of the cloth 400, resulting in improvement in usability for the user in printing the image on the cloth 400.

According to the embodiments described above, the cassette 200 that has a box shape serves as a holder or a cloth holder. Alternatively, the holder may have other shapes and the like as long as the holder is removably attached to a printer and a heating apparatus. For example, the holder may be a single platy platen to be inserted into the printer and the heating apparatus.

As a method to enhance usability for printing, in order to eliminate a process in which the user sets a cloth (e.g., a T-shirt) on the holder every time during printing, the user may use the holder on which the cloth has been set. In this case, the holder after use is collected and the holder on which another cloth has been set is supplied.

Alternatively, in order to attain similar advantages, the user may use a platen on which a cloth (e.g., a T-shirt) has been set. The platen is removably attachable to the holder. For example, the user attaches the platen mounting the cloth to the holder. After printing and fixing are finished, the user removes the platen mounting the cloth from the holder. The user attaches a next platen on which a cloth has been set to the holder. Printing and fixing are performed on the cloth set on the next platen. In this case, the platen after use is collected and the platen on which another cloth has been set is supplied.

Accordingly, since the user need not set a cloth (e.g., a T-shirt) on the platen every time, the user readily handles a plurality of clothes continuously. Alternatively, the plurality of clothes may be automatically handled continuously.

The embodiments described above use fabric such as a T-shirt as the cloth 400. Alternatively, the embodiments described above are applicable to media including fabric on which an image is printed and heated. In this case, the cloth 400 used in the embodiments described above serves as a medium.

A description is provided of advantages of a heating apparatus (e.g., the heating apparatuses 500, 500A, 500B, 500C, 500D, 500E, 500F, 500G, and 500H).

As illustrated in FIGS. 8, 21, and 34, the heating apparatus includes a body (e.g., the body 501), a holder (e.g., the cassette 200), a receiver (e.g., the receiver 503), a heater (e.g., the heater 504), and a mover (e.g., the lifts 507, 507G, and 580). The receiver and the heater are disposed inside the body. The holder is removably placed inside the body. The holder removably holds a heating object (e.g., the cloth 400). The receiver removably holds the holder. The heater heats the heating object held by the holder. The mover moves one of the receiver and the heater vertically relative to another one of receiver and the heater to a non-contact heating position where the heater does not contact the heating object held by the holder held by the receiver.

Accordingly, the heating apparatus is downsized and improves usability for heating the heating object.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A heating apparatus comprising:

a body;

a holder, removably placed inside the body, to removably hold a heating object;

a receiver to removably hold the holder;

a heater to heat the heating object held by the holder held by the receiver; and a mover to move one of the receiver and the heater vertically relative to another one of the receiver and the heater to a non-contact heating position where the heating object is isolated from the heater.

2. The heating apparatus according to claim 1, wherein the mover includes a lift to lift and lower the one of the receiver and the heater.

3. The heating apparatus according to claim 2, further comprising an opening through which the holder is removably inserted into the body.

4. The heating apparatus according to claim 3, wherein the lift lifts the receiver to a position where a surface of the heating object is higher than an upper end of the opening when the heater heats the heating object held by the holder.

5. The heating apparatus according to claim 3, further comprising a door opened and closed to expose and cover the opening.

6. The heating apparatus according to claim 5, wherein the door is interlocked with the receiver to lift and lower the receiver in accordance with opening and closing of the door.

7. The heating apparatus according to claim 5, wherein the lift lifts and lowers the receiver to:

a first position when the door is closed; and a second position which is lower than the first position when the door is opened.

8. The heating apparatus according to claim 5, further comprising an operation portion, disposed outside the body, to control the lift to lift and lower.

9. The heating apparatus according to claim 8, wherein the operation portion causes the lift to lift and lower the receiver to:

a standby position where the holder holding the heating object is inserted into and removed from the body;

the non-contact heating position where the heating object is isolated from the heater; and a contact heating position where the heating object contacts the heater.

10. The heating apparatus according to claim 8, wherein the operation portion includes a control panel to control the lift to lift and lower the receiver while the door is closed.

11. The heating apparatus according to claim 8, wherein the operation portion causes the lift to lift and lower the heater.

12. The heating apparatus according to claim 11, wherein the operation portion causes the lift to lift and lower the heater while the door is closed.

13. The heating apparatus according to claim 12, wherein the operation portion includes a lever including a catch disposed outside the body, and wherein the catch causes the lift to lift and lower the heater to:

a first position where the heating object is isolated from the heater; and a second position where the heating object contacts the heater.

14. The heating apparatus according to claim 13, further comprising a restrictor to restrict motion of the door to prohibit the door from being opened while the heater is at the second position.

15. The heating apparatus according to claim 5, wherein the receiver includes a receiving face to receive the holder, and wherein the door includes an interior face being contiguous to the receiving face of the receiver while the door is opened.

16. The heating apparatus according to claim 15, wherein a height of the interior face of the door is equivalent to a height of the receiving face of the receiver while the door is opened.

17. The heating apparatus according to claim 15, wherein the receiver includes a slope being contiguous to the receiving face and being in proximity to the door, and wherein the receiving face of the receiver is contiguous to the interior face of the door via the slope of the receiver while the door is opened.

18. The heating apparatus according to claim 1, wherein the mover selectively moves the receiver to a contact heating position where the heating object contacts the heater and the non-contact heating position where the heating object is isolated from the heater.

19. The heating apparatus according to claim 1, wherein the heating object includes fabric.

20. An image forming system comprising:

a cloth holder to removably hold fabric;

a printer, removably attached with the cloth holder, to print an image on the fabric held by the cloth holder; and a heating apparatus, removably attached with the cloth holder, to heat the fabric bearing the image and being held by the cloth holder, the heating apparatus comprising:

a body inside which the cloth holder is removably placed;

a receiver to removably hold the cloth holder;

a heater to heat the fabric held by the cloth holder held by the receiver; and a mover to move one of the receiver and the heater vertically relative to another one of the receiver and the heater to a non-contact heating position where the fabric is isolated from the heater.

* * * * *